US009788620B1

(12) United States Patent
Parkinson

(10) Patent No.: US 9,788,620 B1
(45) Date of Patent: Oct. 17, 2017

(54) ELECTRONIC DEVICE COVER

(71) Applicant: Ideo Plastics Inc., Chilliwack (CA)

(72) Inventor: Kevin Parkinson, New Westminster (CA)

( * ) Notice: Subject to any disclaimer, the term of this patent is extended or adjusted under 35 U.S.C. 154(b) by 0 days.

(21) Appl. No.: 15/208,438

(22) Filed: Jul. 12, 2016

(51) Int. Cl.
*A45C 11/00* (2006.01)
*A45C 13/00* (2006.01)

(52) U.S. Cl.
CPC ..... *A45C 11/00* (2013.01); *A45C 13/002* (2013.01); *A45C 13/008* (2013.01); *A45C 2011/001* (2013.01); *A45C 2011/002* (2013.01)

(58) Field of Classification Search
CPC ..... A45C 11/00; A45C 13/002; A45C 13/008; A45C 2011/001; A45C 2011/002; H04B 1/3888; H04B 1/18
See application file for complete search history.

(56) References Cited

U.S. PATENT DOCUMENTS 8,457,701 B2 6/2013 Diebel
8,509,864 B1 8/2013 Diebel
8,531,824 B2 9/2013 Rayner
8,564,950 B2 10/2013 Rayner
8,570,737 B2 10/2013 Rayner
8,644,011 B2 * 2/2014 Parkinson ..... B29C 33/485 224/191
8,973,752 B2 3/2015 Johnson et al.
9,223,346 B2 * 12/2015 Wilson ..... H04B 1/3888
9,264,089 B2 * 2/2016 Tages ..... H04M 1/185
9,408,448 B2 * 8/2016 Kay ..... A45C 13/36
9,462,099 B2 * 10/2016 Wilson ..... H04M 1/185
9,537,526 B2 * 1/2017 Wilson ..... H04B 1/3888
2009/0260844 A1 * 10/2009 Tseng ..... H05K 5/069 174/50.5
2011/0073608 A1 * 3/2011 Richardson ..... A45C 11/00 220/737
2012/0118773 A1 * 5/2012 Rayner ..... G06F 1/1626 206/320
2012/0321294 A1 12/2012 Tages et al.
2013/0043777 A1 2/2013 Rayner
2014/0069736 A1 3/2014 Freshman et al.
2015/0136819 A1 5/2015 Yang

* cited by examiner

*Primary Examiner* — Corey Skurdal

(57) ABSTRACT

A cover for forming a watertight enclosure enclosing an electronic device having a display includes: (a) a first member comprising: (i) a protective membrane operable to transmit touchscreen-type user input to the display; and (ii) a sealing mount attached to the protective member, the sealing mount defining a registration profile extending along the entire perimeter of the protective membrane, the sealing mount defining a stanchion projecting parallel and spaced-apart from the registration profile; and (b) a second member comprising: (iii) a rigid plastic frame; and (iv) a shell over-molded to the frame, the shell being made of a soft and elastomeric material and defining a compression profile extending along the entire perimeter of the shell, the shell at its compression profile being dimensioned for interlocking with the sealing mount at its registration profile so as to removably form a watertight seal between the first and second members.

15 Claims, 33 Drawing Sheets

ELECTRONIC DEVICE COVER

FIELD OF THE INVENTION

The present invention relates to adaptations or augmentations of waterproof covers for electronic devices.

BACKGROUND OF THE INVENTION

With continued advances in technology, today's consumers find themselves with an ever-increasing number of personal digital devices to choose from. These include cellular phones, "smart" phones, personal digital assistants (PDAs), portable global positioning system (GPS) units, compact game systems, compact audio/video players and wireless reading devices for e-books.

While these personal digital devices continue to improve, with an ever-increasing list of features, they still suffer from a long-standing problem: their vulnerability to the elements, in particular dust and water. They are also susceptible to damage from general wear and tear, most noticeably scratching or other adverse impacts on the video screens. Protective covers have therefore been developed in order to protect these personal digital devices and the design of such covers must adapt to the available features of the personal digital devices.

U.S. Pat. No. 8,564,950 to Rayner discloses a housing for covering at least part of a mobile computing device having a touch screen display and a motion-actuated switch. The housing of Rayner includes a clasping mechanism configured such that when top and bottom members of the housing are coupled together a liquid-proof seal is provided. The clasping mechanism of Rayner in some embodiments includes a coin slot feature. The housing of Rayner includes a waterproof gasket that is permissive to sound but not to liquid. The housing of Rayner includes an encasement that enables operation of the touch screen display and covers the switch. The apparatus of Rayner further includes a switch mechanism that includes a switch actuator protruding from an outer surface of the encasement and covered by a flexible seal attached to the encasement. However, the clasping mechanism of Rayner and its coin slot feature renders the housing of Rayner cumbersome for some users.

Objects of embodiments of the invention will be apparent from the description that follows.

SUMMARY OF THE INVENTION

The present invention is a cover for an electronic device, whereby a protective membrane is incorporated to a sealing mount or frame. The protective membrane with sealing mount connectively seals into a soft plastic shell that overmolds a hard, translucent frame with reciprocal compression seals to complete a waterproof enclosure. The over-molded soft, elastomeric shell fully encompasses the outer perimeter of the hard translucent shell, providing shock absorbency. The cover includes a sound-isolation chamber and sound isolating, acoustic membranes extending across the cover's speaker and microphone apertures. The case design improves the sound pressure or timbre within the cover, by isolating and maximizing the transmission of sound from the speakers or into the microphones effectively eliminating all echoes. An acoustic chamber captures and amplifies sound inside the cover when the electronic device is in speakerphone mode. For those electronic devices with a camera and flash, the lens frame incorporates fully integrated polycarbonate lenses for the camera and flash apertures of the cover.

The cover's membrane over the home button is tear-resistant and waterproof and allows for "fingerprint recognition" or digital authentication technology.

In accordance with the first embodiment of the invention, there is provided a protective cover for an electronic device having a touch screen. The cover includes a front component having a protective membrane incorporated with a silicone or silicone and plastic sealing mount. The back component consisting of a hard translucent plastic frame that is overmolded with a soft elastomeric shell, the encasement being removably connectable to the mounted protective membrane to fully encase the electronic device when inserted into the shell. The encasement and the mounted protective membrane may sealably engage together with a combination of reciprocal registration and compression profiles to complete a waterproof seal.

The protective membrane may include a waterproof, sound isolating, acoustic membrane comprised of one or more materials over the electronic device's earpiece speaker and, a waterproof membrane over the electronic device's home button that allows users of an electronic device to unlock their electronic devices having a sensor for a fingerprint.

The frame and shell encasement may include a sound isolating, acoustic membrane situated over the electronic device's bottommost microphone and a sound-isolation chamber situated over the electronic device's bottommost speaker. The frame may include fully integrated protective lenses situated over the electronic device's camera lens and flash. The protective cover may further include a camera-flash frame around the lenses that is fully integrated by thermal and chemical bonding to the translucent frame. The camera-flash frame may include a sound isolating, acoustic membrane situated over the electronic device's auxiliary microphone. In accordance with specific aspects of the invention, there is provided a cover for enclosing an electronic device having a display so as to form a watertight enclosure. The cover includes: (a) a first member comprising: (i) a first-member sealing mount made of rigid plastic and/or silicone materials; (ii) a protective membrane made of glass attached to the first-member sealing mount, the protective membrane being operable to transmit touch-screen-type user input to the display; (iii) a first-member seal projecting from the first-member sealing mount, the first-member seal defining a registration profile extending along the entire perimeter of the first-member sealing mount; and (iv) a stanchion projecting from the first-member sealing mount, the stanchion projecting parallel and spaced-apart from the first-member seal along the entire perimeter of the first-member sealing mount; and (b) a second member comprising: (v) a second-member frame made of a rigid plastic material; and (vi) a soft, elastomeric shell overmolded to the second-member frame, the shell defining a compression profile extending along the entire perimeter of the shell, the shell at the compression profile being dimensioned for interlocking with the first-member seal at the registration profile so as to removably form a watertight seal between the first and second members, said shell may have a soft-touch coating chemically applied over the elastomeric material.

The first-member may be dimensioned for placement adjacent to a front side of the electronic device when the watertight enclosure is formed. The second-member may be dimensioned for placement adjacent a rear side of the electronic device when the watertight enclosure is formed. The first member may include a first sound isolating, acoustic membrane attached to the first-member protective membrane or a border region of the protective membrane. The border region may surround the protective membrane. The first sound isolating acoustic membrane may include: (i) an annular foam gasket, (ii) a hydrophobic or waterproof membrane adjacent to the annular foam gasket, and (iii) a metallic screen or mesh adjacent to the waterproof membrane. The first sound isolating, acoustic guide may be dimensioned for alignment with an earpiece speaker of the electronic device such that the annular foam gasket is closer than the metallic screen to the electronic device when the watertight enclosure is formed. The first member may include a film attached to the first-member border region of the first-member protective membrane. The film may be substantially transparent. The film may be dimensioned for alignment with a camera lens and sensors of the electronic device when the watertight enclosure is formed. The first member may include a waterproof membrane attached to the first-member protective membrane. The waterproof membrane may be opaque or transparent. The waterproof membrane may be dimensioned for alignment over the electronic device's home button when the watertight enclosure is formed. The second member may include a second sound isolating, acoustic membrane attached to the shell. The second acoustic membrane may include: (i) a second waterproof membrane, whereby at least one flange or annular wall is projecting from the second waterproof membrane, the at least one annular wall being operable to guide sound therethrough, and (ii) a second metallic screen attached to the waterproof membrane. The second sound isolating, acoustic membrane may be dimensioned for alignment with a mouthpiece microphone of the electronic device such that the second waterproof membrane is closer than the second metallic screen to the electronic device when the watertight enclosure is formed. The second-member may include a third sound isolating, acoustic membrane. The third acoustic membrane may include: (i) a waterproof membrane having a flange or annular wall projecting from the waterproof membrane, the annular wall being operable to guide sound therethrough, and (ii) a metallic screen attached to the waterproof membrane. The third acoustic membrane may be dimensioned for alignment with an auxiliary microphone of the electronic device such that the waterproof membrane is closer than the metallic screen to the electronic device when the watertight enclosure is formed. The second member may form a sound-isolation chamber in fluid communication with a speakerphone-mode speaker of the electronic device. The sound from the speaker is isolated by the sound-isolation chamber and directed to an acoustic chamber. The acoustic chamber may be dimensioned to extend between a rear side of the electronic device and the second-member when the watertight enclosure is formed. The acoustic chamber may be dimensioned to extend along substantially the entire rear side of the electronic device. The cover may define a camera-flash frame attached to the second-member frame. The camera-flash frame may include a partition between the camera and flash apertures to diffuse reflection and prevent glare from the flash onto the rear-facing camera lens and acoustically isolating from the acoustic chamber an auxiliary-microphone portion of the camera-flash frame. The camera-flash frame may be thermally and chemically bonded to the second-member frame. The second-member frame may be translucent. The second-member frame may include fully integrated lenses situated over the cover's rear-facing camera lens and flash apertures. The second-member may further include a rigid cap attached to the shell. An exterior portion of the rigid cap may protrude outwardly from the shell. An interior portion of the rigid cap may engage a toggle switch of the electronic device when the watertight enclosure is formed.

In accordance with another embodiment of the invention, there is provided a cover for forming a watertight enclosure enclosing an electronic device having a display. The cover includes: (a) a first member comprising: (i) a protective membrane operable to transmit touchscreen-type user input to the display; and (ii) a sealing mount attached to the protective member, the sealing mount defining a registration profile extending along the entire perimeter of the protective membrane, the sealing mount defining a stanchion projecting parallel and spaced-apart from the registration profile; and (b) a second member comprising: (iii) a second-member frame made of a rigid plastic material; and (iv) a shell over-molded to the second-member frame, the shell being made of a soft and elastomeric material, the shell defining a compression profile extending along the entire perimeter of the shell, the shell at the compression profile being dimensioned for interlocking with the sealing mount at the registration profile so as to removably form a watertight seal between the first and second members.

The protective membrane may be made of a material selected from the group consisting of: glass, and plastic. The registration profile may include a core made of rigid plastic and an overlay portion made of silicone. The overlay portion may be overmolded to the core. The core and the stanchion may be integral to each other. The sealing mount may be made solely of silicone. The sealing mount may be thermally and chemically bonded to the protective membrane. The first member may include a first acoustic membrane attached to the protective membrane at a border region of the protective membrane. The first acoustic membrane may include: (i) an annular foam gasket, and (ii) a membrane member disposed adjacent to the annular foam gasket. The first acoustic membrane may be operable to isolate sound. The first acoustic membrane may be dimensioned for alignment with an earpiece speaker of the electronic device. The gasket may be operable to guide sound therethrough. The membrane member may be selected from the group consisting of a waterproof member and a hydrophobic member. The second member may include a second acoustic membrane attached to the shell. The second acoustic membrane may be operable to isolate sound. The second acoustic membrane may include a second waterproof membrane member and at least one annular wall projecting from the second waterproof membrane member. The at least one annular wall may be operable to guide sound therethrough. The second acoustic membrane may be dimensioned for alignment with a mouthpiece microphone of the electronic device. At least one of the first member and the second member may include a third acoustic membrane being operable to isolate sound. The third acoustic membrane may include a third waterproof membrane member and at least one annular wall projecting from the third waterproof membrane member. The at least one annular wall may be operable to guide sound therethrough. The third acoustic membrane may be dimensioned for alignment with an auxiliary microphone of the electronic device. The second member may define a sound-isolation chamber dimensioned for placement into fluid communication with a speakerphone-mode speaker of the electronic device. The sound-isolation chamber may be dimensioned to isolate sound emitted from the speakerphone-mode speaker and transmit the sound from the speakerphone-mode speaker into an acoustic chamber defined by the cover. The acoustic chamber may extend between a rear side of the electronic device and at least one of the first member and the second member when the watertight enclosure is formed. The second-member frame may be translucent. The second-member frame may include a camera-flash frame. The camera-flash frame may be over-molded to the second-member frame. The camera-flash frame may include a partition for acoustically isolating from the acoustic chamber an auxiliary-microphone portion of the camera-flash frame. The partition may be dimensioned to diffuse light produced by a flash of the electronic device and to minimize glare produced by the flash and appearing incident on a camera lens of the electronic device. The second-member frame may contiguously define a first lens dimensioned for alignment with a rear-facing camera of the electronic device. The second-member frame may contiguously define a second lens dimensioned for alignment with a rear-facing flash of the electronic device. The camera-flash frame may encase the first and second lenses. The first and second lenses may be operable to protect the rear-facing camera and the rear-facing flash. The camera-flash frame may be thermally and chemically bonded to the second-member frame. The second member may further include a rigid plastic cap attached to the shell. An exterior portion of the rigid plastic cap may protrude outwardly from the shell. An interior portion of the rigid plastic cap may engage a toggle switch of the electronic device when the watertight enclosure is formed. The rigid plastic cap may be thermally and chemically bonded to the shell. The sealing mount may be thermally and chemically bonded to the protective membrane.

In accordance with another embodiment of the invention, there is provided a protective cover for an electronic device having a touch screen. The first-member may be dimensioned to enclose a top portion of the electronic device when the watertight enclosure is formed. The second-member may be dimensioned to enclose a bottom portion of the electronic device when the watertight enclosure is formed. The first-member having a protective membrane, a translucent, hard plastic frame, a soft, elastomeric shell and a sealing mount. The sealing mount may be made of hard plastic and/or silicone.

The second-member is an end-cap comprised of a soft, elastomeric interior over-molded with a hard plastic exterior, thermally and chemically fused together. The top component may be removably connectable to the end-cap to fully encase the electronic device when inserted into the shell. The sealing mount and the end-cap may sealably engage together with a combination of reciprocal registration and compression profiles to complete a waterproof seal.

The protective membrane may define a convex profile dimensioned for alignment with an earpiece speaker of the electronic device. The protective membrane may be sufficiently thin at the convex profile to permit acoustic transmission through the protective membrane. The protective membrane may include a waterproof membrane over the electronic device's home button that allows users of an electronic device to unlock their electronic devices having a sensor for a fingerprint.

The cover may include an acoustic chamber, a sound-isolation chamber and a sound isolating, acoustic membrane extending across the cover's speaker and microphone apertures. The sound-isolation chamber may be dimensioned to isolate sound emitted from a speakerphone-mode speaker of the electronic device and transmit the sound from the speakerphone-mode speaker into the acoustic chamber. The acoustic chamber may extend between a rear side of the electronic device and an inward face of a rear side of the first member when the watertight enclosure is formed. The protective cover may further include a protective camera-flash frame that is fully integrated with the translucent frame by thermal and chemical bonding to the frame. The frame may include fully integrated lenses situated over the cover's camera lens and flash apertures. The camera-flash frame may include a sound isolating, acoustic membrane positioned over the cover's aperture for the electronic device's auxiliary microphone.

The second-member may further include a rigid cap attached to the shell. An exterior portion of the rigid cap may protrude outwardly from the shell. An interior portion of the rigid cap may engage a toggle switch of the electronic device when the watertight enclosure is formed.

BRIEF DESCRIPTION OF THE DRAWINGS

These and other features of the invention will become more apparent from the following description in which reference is made to the appended drawings and wherein.

DETAILED DESCRIPTION OF THE PREFERRED EMBODIMENT

Figure 1A:
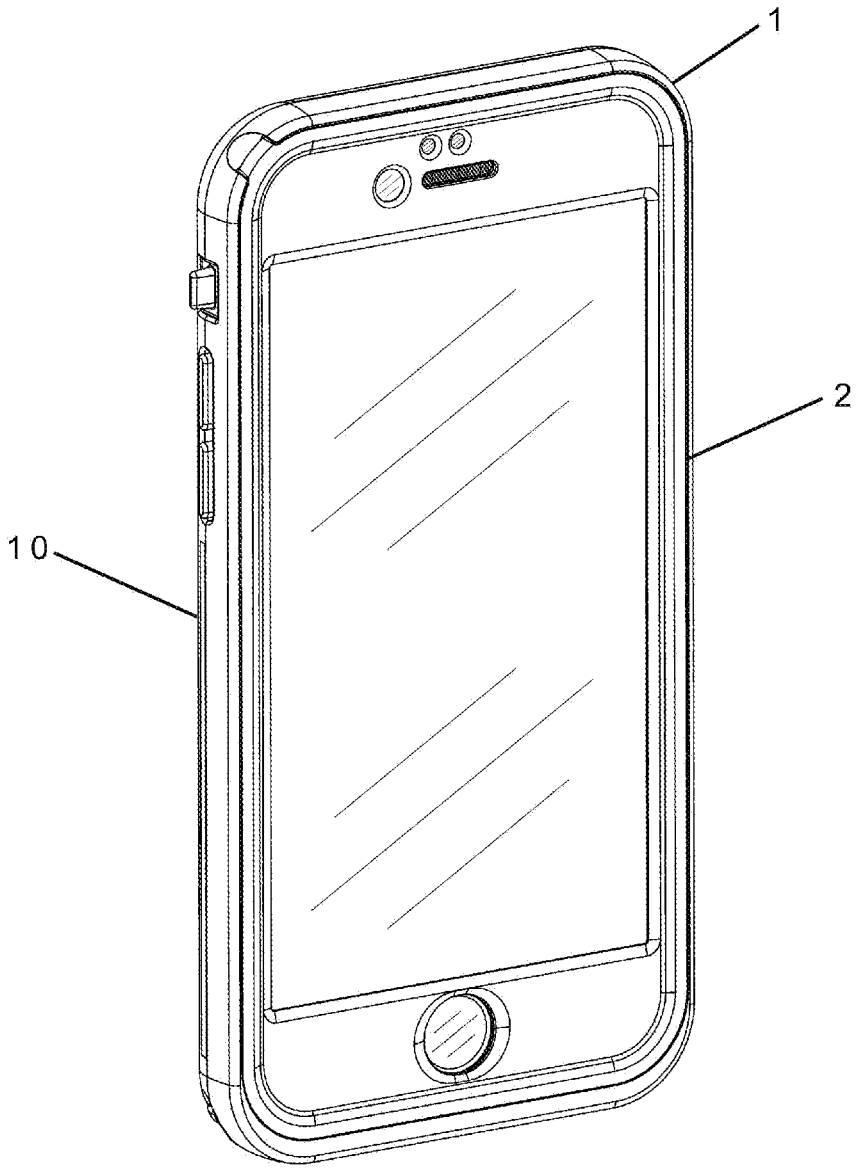
FIG. 1*a* is a front perspective view of a cover according to a first embodiment of the invention, showing a front portion of the cover connected to a back portion of the cover to form a waterproof enclosure for an electronic device.

The first and preferred embodiment of an electronic device cover is shown in FIGS. 1*a* to 4*c*. The embodiment of the electronic device cover shown in the drawings corresponds to a specific personal digital device (not shown in any of the drawing figures), however it is understood that the actual positioning and availability of the features of the cover further described below can be customized for any electronic device (not shown).

Figure 1B:
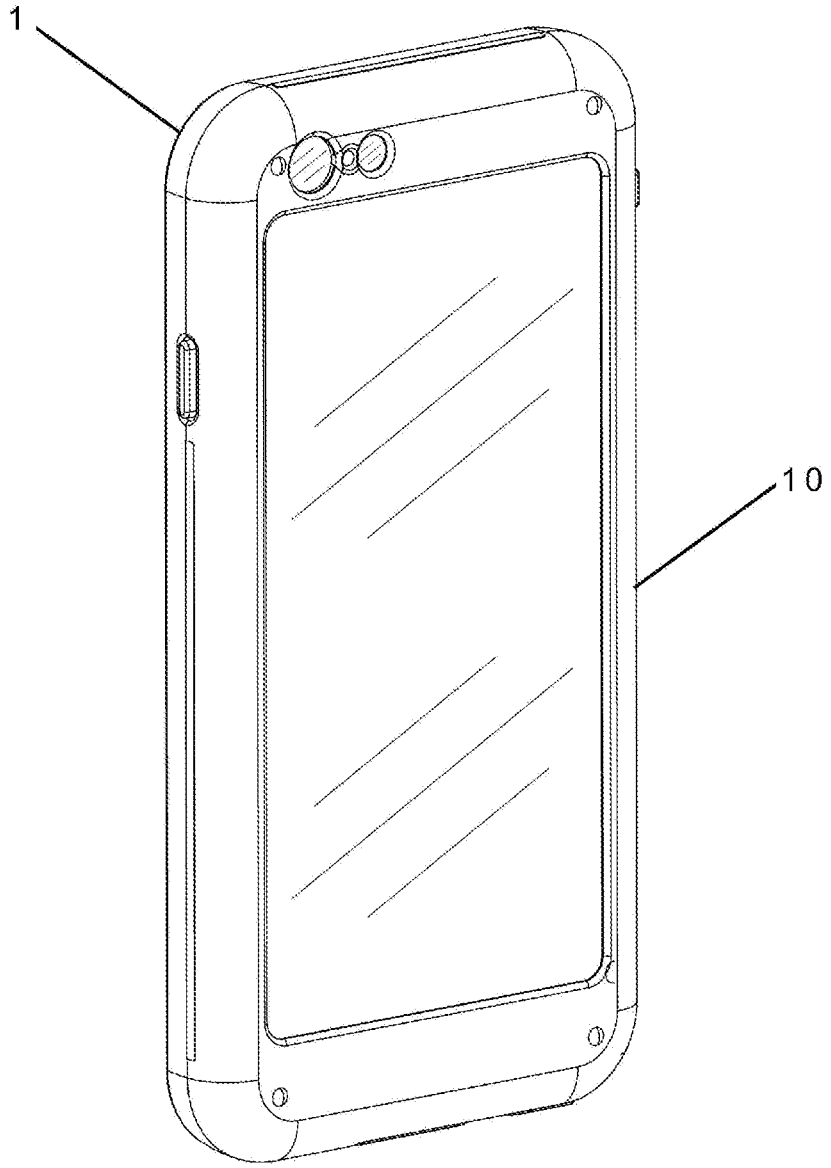
FIG. 1*b* is a rear perspective view of the cover shown in FIG. 1*a*, showing the back portion connected to the front portion to form the waterproof enclosure.

Referring to FIGS. 1*a* and 1*b*, the cover 1 comprises a front portion 2 and a back portion 10 having a back, sides, and an open front through which an electronic device (not shown) can be inserted into the cover 1 prior to connectively sealing the front portion 2 to the back portion 10 to create a waterproof enclosure encasing the electronic device.

Figure 2A:
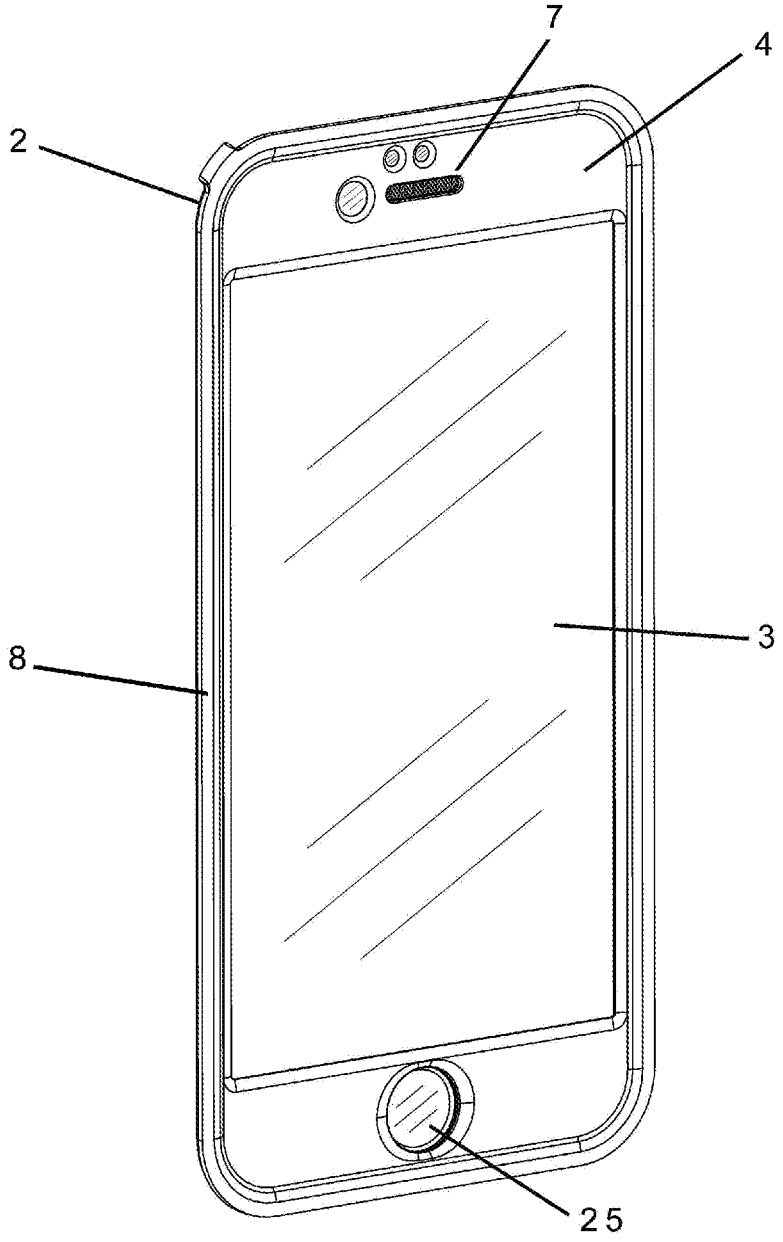
FIG. 2*a* is a perspective view of the front portion shown in FIG. 1*a*, showing a protective membrane, a border on the protective membrane, a sealing mount, a sound isolating, acoustic membrane for the earpiece speaker, and a waterproof membrane for over the electronic device's home button.

Referring to FIG. 2*a*, the front portion 2 comprises a protective membrane 3 with a plastic border 4 attached to a hard plastic and silicone sealing mount 8, a sound isolating, acoustic membrane 7 for the electronic device's earpiece speaker (not shown), and a waterproof membrane 25 for covering the electronic device's home button (not shown). The protective membrane 3 is positioned so as to correspond to the position of the screen of the electronic device (not shown) to be placed in the cover 1. The protective membrane 3 is adapted to allow viewing of the electronic device's screen (not shown), and use thereof in the case of touch screens. The inner perimeter of the sealing mount 8, which frames the outer perimeter of the protective membrane 3, is angled at 45° to maximize the contact area on the electronic device's touch-screen display (not shown).

Figure 2B:
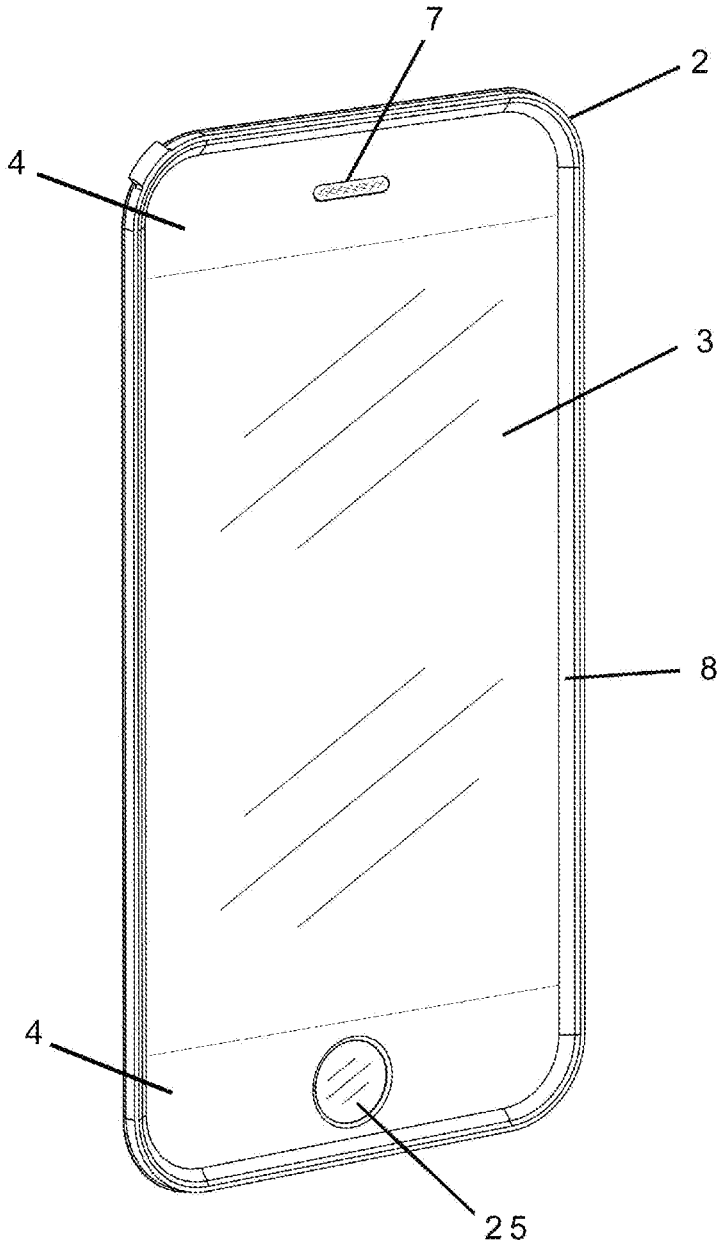
FIG. 2*b* is a perspective view of an alternate configuration of the front portion, showing the protective membrane having a silkscreen-made border at the top and bottom perimeter of the protective membrane, a sealing mount, a sound isolating, acoustic membrane for the earpiece speaker, and a waterproof membrane for over the home electronic device's button.

FIG. 2*b* is an alternative embodiment of the front portion 2 whereby the border 4 on the protective membrane 3 is silkscreened and the sealing mount 8 is manufactured from only silicone. The sealing mount 8 is chemically and thermally adhered to the protective membrane 3 during the manufacturing process.

Figure 2C:
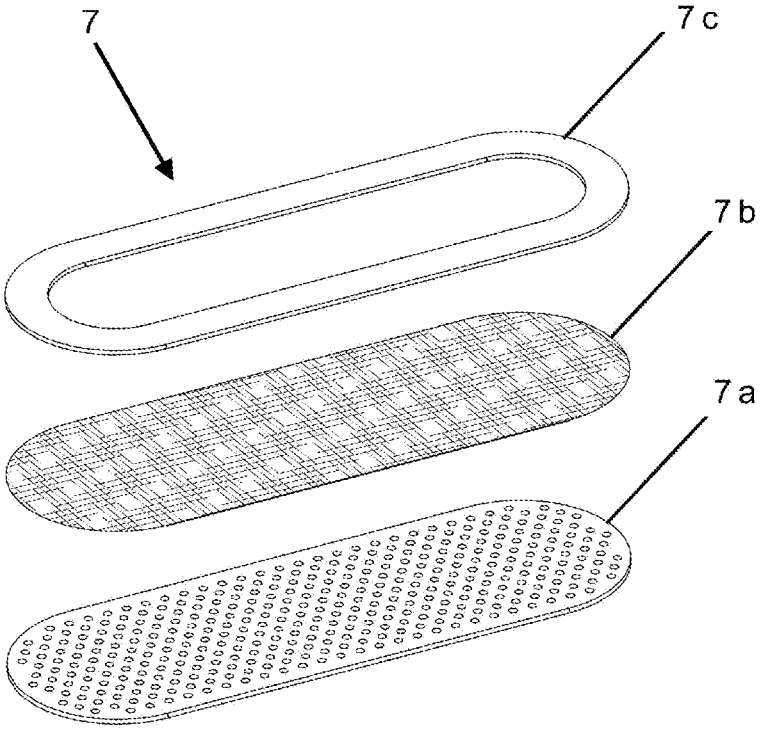
FIG. 2*c* is an exploded view of the sound isolating, acoustic membrane shown in FIGS. 2*a* and 2*b*, showing a perforated metal screen, hydrophobic material and a foam gasket.
Figure 2D:
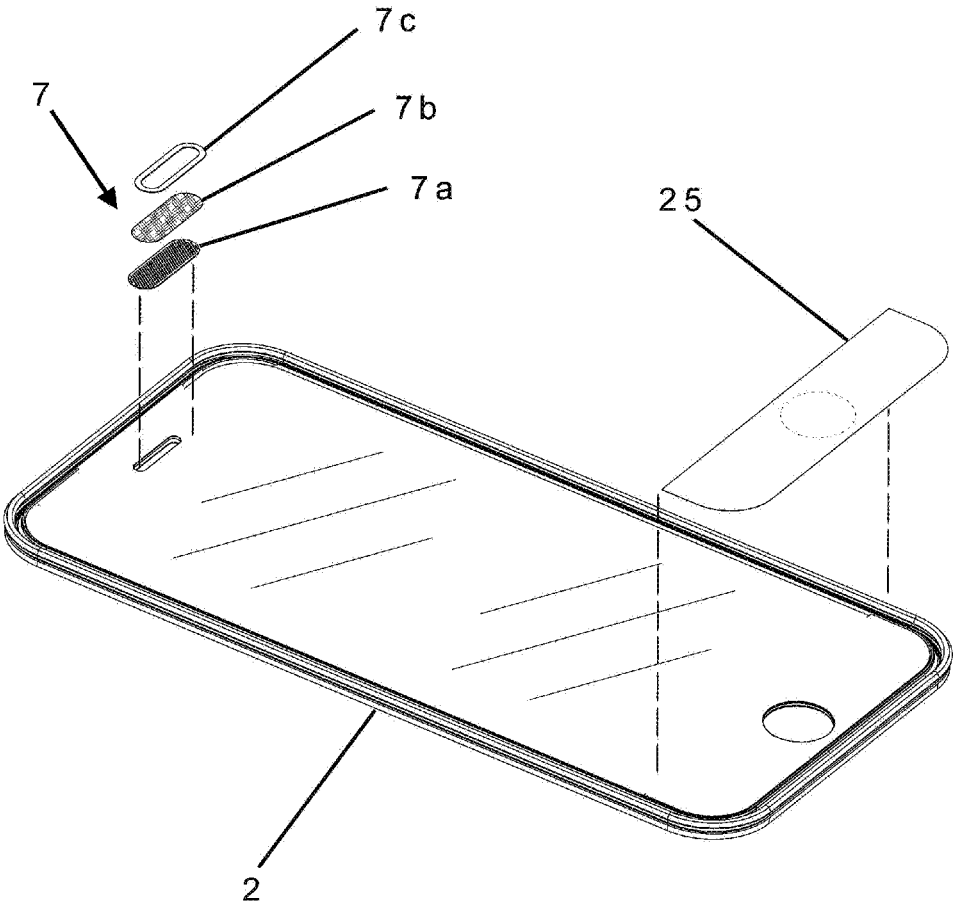
FIG. 2*d* is an exploded view of the reverse side of the front portion shown in FIGS. 2*a* and 2*b*, showing the sound isolating, acoustic membrane and the waterproof membrane for over the home electronic device's button.

Referring to FIGS. 2*a*, 2*c* and 2*d*, the protective membrane 3 incorporates a sound isolating, acoustic membrane 7 extending across the earpiece-speaker aperture of the front portion 2. The sound isolating, acoustic membrane 7 comprises a three-layer composition of perforated metal screen 7*a*, hydrophobic material 7*b* and a foam gasket 7*c*, which is then adhesively attached to the protective membrane 3. The gasketed, acoustic membrane 7 guides and maximizes the transmission of sound emitted from the speaker (not shown) through the cover 1. Some embodiments do not include the perforated metal screen 7*a*. The plastic border 4 on the protective membrane 3 features apertures for the earpiece speaker (not shown), forward-facing camera lens (not shown), sensors (not shown) and the home button (not shown) of the electronic device.

Referring again to FIG. 2*d*, the home button (not shown) on the electronic device is designed so that it scans, reads and recognizes fingerprints but it also relies on bio-electromagnets (electromagnetic fields produced by living cells, tissues or organisms). The cover 1 provides an ultra-thin, waterproof, tear-resistant home-button membrane 25 conducive to "fingerprint recognition" or digital authentication technology. In the first embodiment, the home-button membrane 25 allows for fingerprint recognition by the electronic device (not shown) via the electronic device's home button through the home-button membrane 25. The home-button membrane 25 is adhesively attached to the interior side of the plastic border 4 and has been embossed to form-fit to the curvature or concavity of the home button (not shown).

Figure 2E:
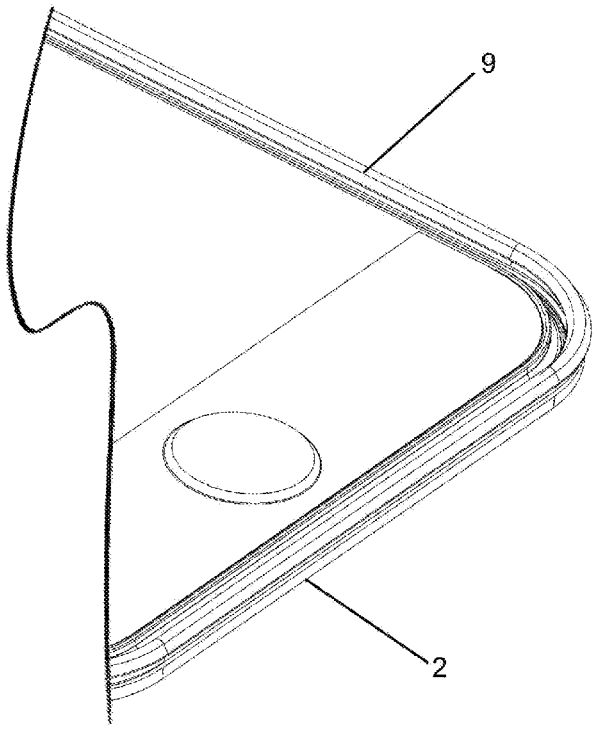
FIG. 2*e* provides a partial view of the front portion shown in FIGS. 2*a* and 2*b*, showing a registration profile of the compression seal in the sealing mount.

FIG. 2*e* depicts the registration profile 9 of the compression seal located on the reverse or interior side of the front portion 2.

Figure 2F:
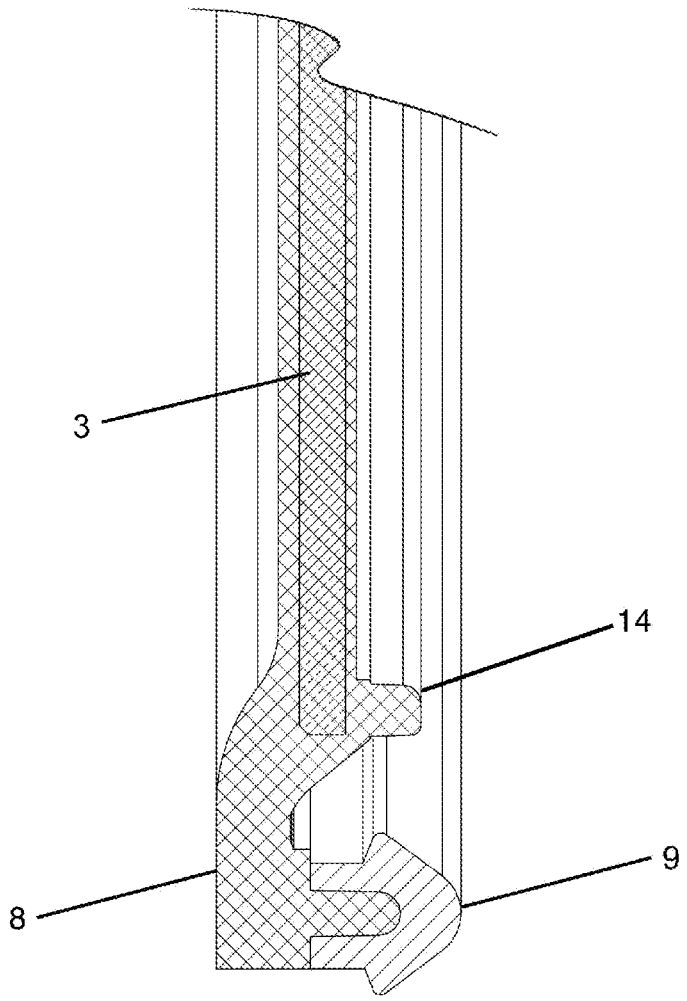
FIG. 2*f* provides a cross-sectional view of the front portion shown in FIGS. 2*a* and 2*b*, showing the protective membrane, the registration profile and a stanchion on the perimeter of the sealing mount.

Referring to FIG. 2*f*, the protective membrane 3 is adhered to the sealing mount 8. The registration profile 9 on the sealing mount 8, which encompasses the perimeter of the sealing mount 8, is manufactured from hard plastic that has been over-molded with silicone and has been fully integrated with the hard plastic core of the registration profile 9 during the molding process. The sealing mount 8 further incorporates a stanchion 14 around the perimeter of the sealing mount 8. The stanchion 14 inhibits the sealing mount 8 from distorting or bending, thereby protecting the integrity of the protective membrane 3 and preventing the sealing mount 8 from dislodging from the soft plastic shell 12 during an impact. Alternatively, as depicted in FIG. 2*b* the entire sealing mount 8, registration profile 9 and stanchion 14 may be manufactured entirely of silicone and may be fully integrated with the protective membrane 3 during the molding process.

Figure 2G:
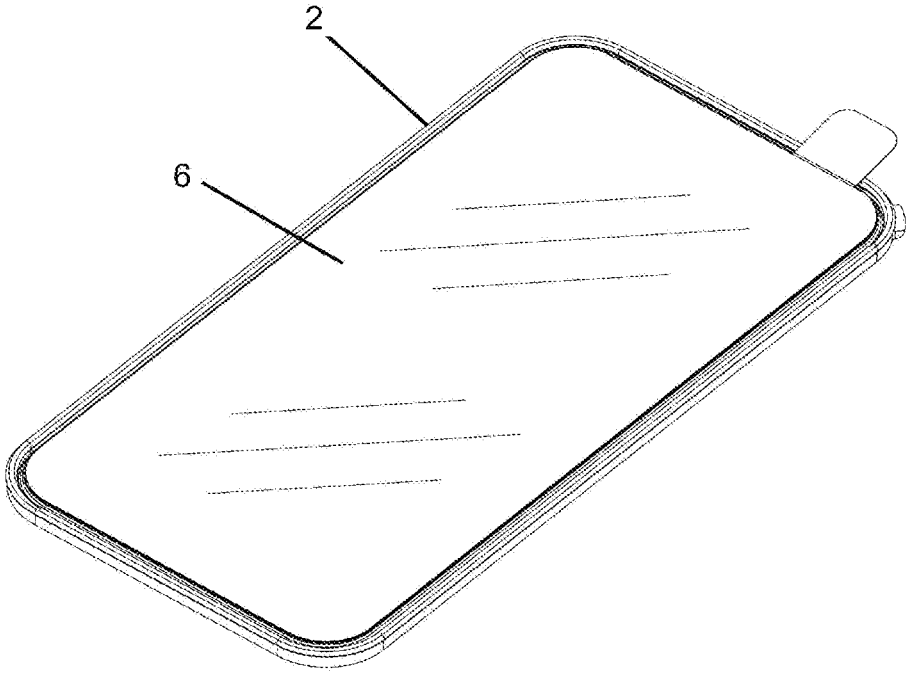
FIG. 2*g* is a perspective view of the removable transparent film overlay on the silicone substrate applied to the reverse side of the protective membrane.

Referring to FIG. 2*g*, the front portion 2 includes a silicone substrate applied to the inside surface of the protective membrane 3. The silicone substrate allows the protective membrane 3 to chemically adhere to the electronic device's screen (not shown). The front portion 2 includes a transparent film 6 applied over the silicon substrate on the inner side of the protective membrane 3. The transparent film 6 prevents the protective membrane 3 from adhering to the electronic device's screen, thereby allowing the front portion 2 to be easily removed from the electronic device (not shown). Thus, a user may decide to not remove the transparent film 6 before enclosing the electronic device by the cover 1 such that the cover 1 removably encloses the electronic device, or the user may decide to remove the transparent film 6 before enclosing the electronic device by the cover 1 such that the cover 1 more securely encloses the electronic device (not shown).

Figure 2H:
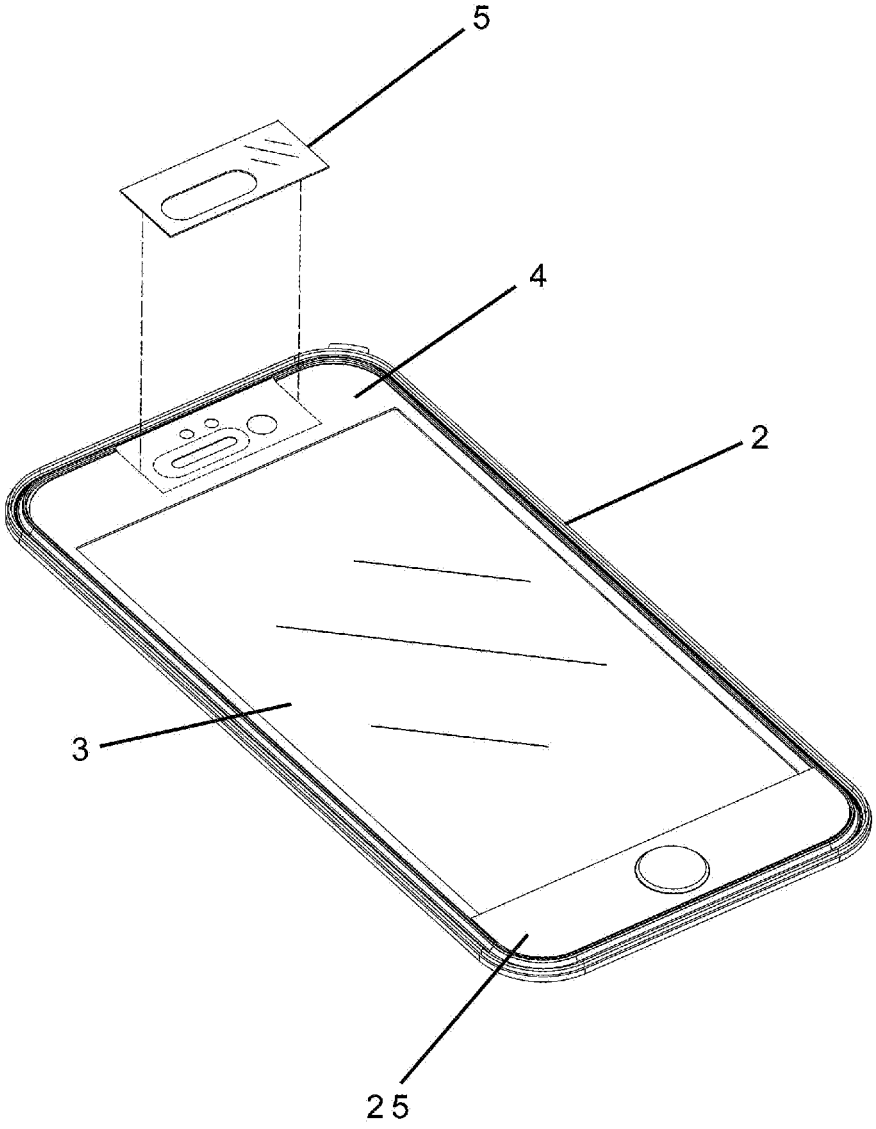
FIG. 2*h* is a perspective view of the reverse side of the front portion absent the removable transparent film overlay, showing the plastic border, a transparent film dimensioned to be adhesively applied to the reverse side of the plastic border, the relationship between the transparent film and the plastic border being shown in exploded view, and the waterproof membrane for over the home electronic device's button.

As can be seen in FIG. 2*h*, the plastic border 4 includes a separate, transparent film 5 adhesively applied to the inward-facing side of the plastic border 4 to protect the forward-facing camera lens and sensors without inhibiting functionality of the forward-facing camera and sensors. The transparent film 5 covers apertures in the front portion 2 related to the forward-facing camera lens and sensors. The home-button membrane 25 is adhesively attached to the interior side of the plastic border 4 and has been embossed to form-fit to the curvature or concavity of the home button (not shown).

Figure 2I:
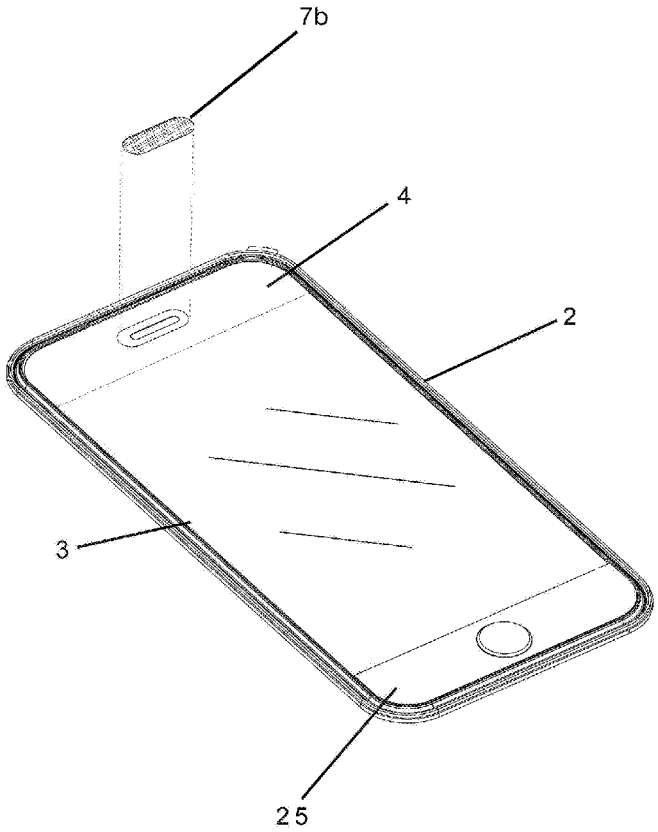
FIG. 2*i* is a perspective view of an alternate configuration of the front portion absent the removable transparent film overlay, showing the protective membrane having a silk-screen-made border at the top perimeter of the protective membrane, a hydrophobic or waterproof, acoustic membrane for the earpiece speaker, and a waterproof membrane for over the home electronic device's button.

FIG. 2*i* is an alternate embodiment of the front portion 2 (FIGS. 2*b* and 2*h*), seen from its reverse side, whereby the border 4 on the protective membrane 3 is silkscreened and the acoustic membrane 7 for the electronic device's earpiece speaker (not shown) is a single layer hydrophobic or waterproof membrane 7*b*.

Referring to FIGS. 1*b* and 3*a* to 3*g*, the back portion 10 of the cover 1 comprises a hard translucent frame 11 that is over-molded with a soft durometer shell 12. The shell 12 typically has a durometer in the range of 60 Shore A to 90 Shore A, such that the shell 12 is soft relative to the translucent frame 11. The translucent frame 11 contains cut-outs that provide access to the protrusions and contours of the shell 12. The protrusions and contours of the soft shell 12 correspond to the positions of the electronic device's features and peripheral controls. The soft shell 12 includes a power toggle switch enclosure 12*a*, volume switches enclosures 12*b* and ring/silent toggle switch cap 15.

Figure 3A:
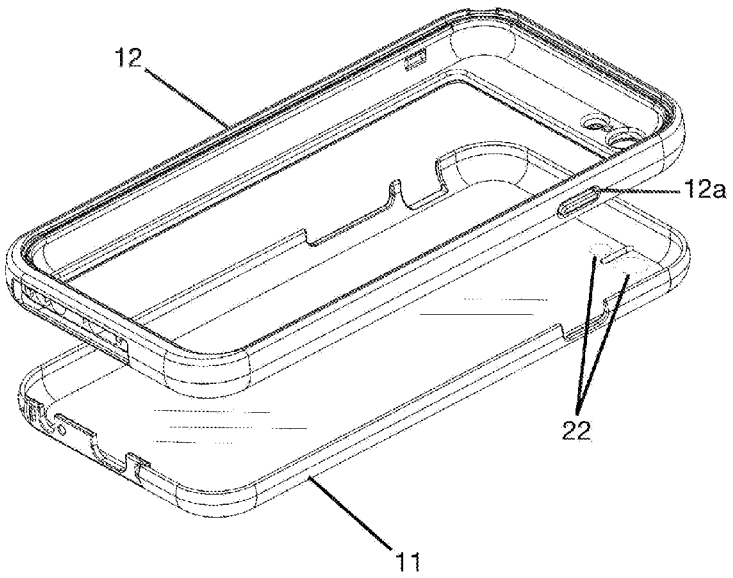
FIG. 3*a* is an exploded perspective view of the back portion shown in FIG. 1*b*, showing a hard, translucent plastic frame, a soft, elastomeric shell having a power toggle switch enclosure that is molded into the soft, elastomeric shell, and lenses for camera and flash apertures that are integrated with the translucent frame.

FIG. 3*a* depicts the lenses 22, for the rear facing camera and flash apertures, which are integrated with the translucent frame 11.

Figure 3B:
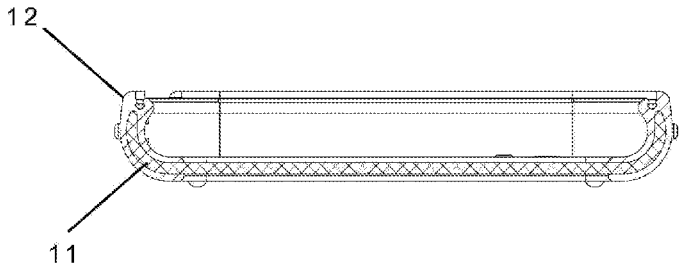
FIG. 3*b* is a cross-sectional view of the back portion shown in FIG. 1*b*, showing the hard, translucent plastic frame over-molded with the soft plastic shell.

FIG. 3*b* shows by cross-sectional view the frame 11 over-molded by the soft shell 12.

Figure 3C:
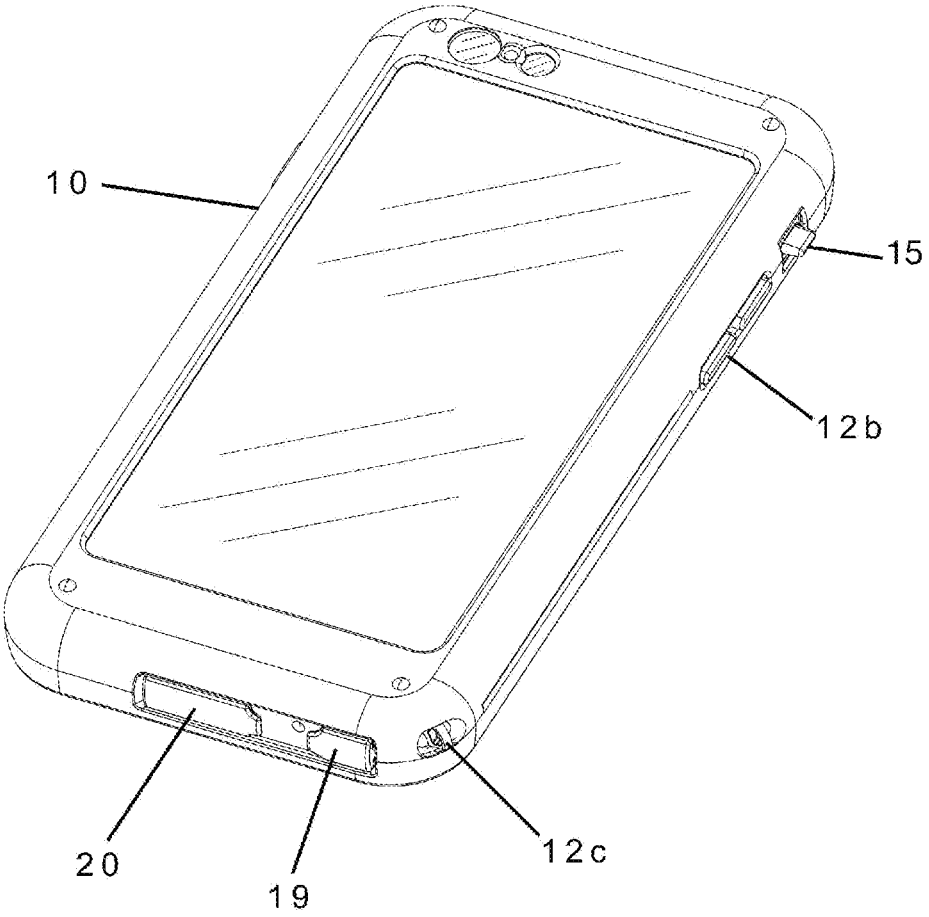
FIG. 3*c* is a perspective view of the back portion shown in FIG. 1*b*, showing a hard plastic cap for the ring/silent toggle switch, volume switch enclosures, lanyard receptacle and respective seals in closed positions for the headphone jack port and charging port of the electronic device.

Referring to FIG. 3*c*, a seal 19 on the outer side of the back portion 10 closes the headphone-jack aperture of the frame 11 with a waterproof seal when a headphone jack (not shown) is not in use. Similarly, seal 20 is operable to close a charging-port aperture of the frame 11 corresponding to the charging port (not shown) of the electronic device. Seals 19 and 20 are hingedly connected to the frame 11 and both are shown in the closed position. The shell 12 also features a molded receptacle 12*c* for a removable lanyard.

Figure 3D:
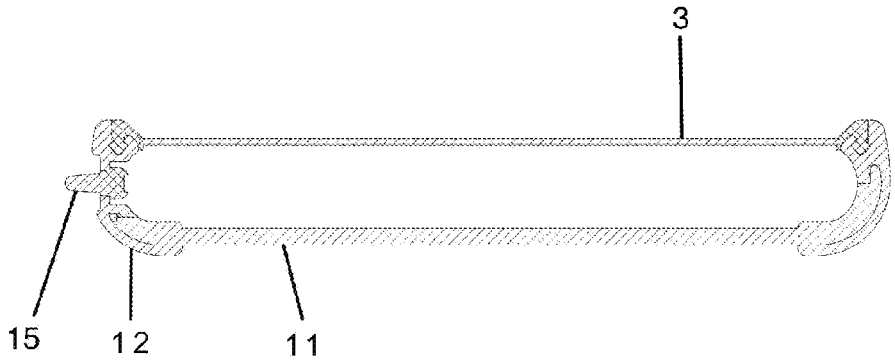
FIG. 3*d* is a cross-sectional view of the back portion of FIG. 1*b*, showing the hard plastic cap for the ring/silent toggle switch protruding through the soft shell.

Referring to FIG. 3*d*, the shell 12 incorporates a hard plastic cap 15 that is contoured to fit over the electronic device's ring/silent toggle switch (not shown), thereby allowing the switch to be toggled by means of leveraged actuation. The cap 15 is partially over-molded by the shell 12 so that the cap 15 partially protrudes through the shell 12. The toggle switch cap 15 is thermally and chemically incorporated to the soft shell 12 during the injection molding process. The outward protrusion of the cap 15 advantageously facilitates toggling of the electronic device's ring/silent toggle switch by providing a mechanical advantage to reduce the extent of finger pressure required to toggle the electronic device's ring/silent toggle switch (not shown).

Referring again to FIG. 3*e*, a sound-isolation chamber 17 insulates the speakerphone-mode speaker (not shown) of the electronic device and is fully incorporated into the frame 11 of the back portion 10. The sound-isolation chamber 17 isolates sound emitted from the electronic device's speakerphone-mode speaker and transmits it from the speaker into the acoustic chamber space of the cover 1. When the electronic device is being encased by the cover 1, the acoustic chamber in the first embodiment extends between the rear side of the electronic device and an inner side of the back portion 10. The acoustic chamber advantageously facilitates the emission of sound from the electronic device's speakerphone-mode speaker via acoustic resonance in the back portion 10. The soft shell 12 at its inner side incorporates a molded annular seal 16 for the headphone-jack aperture to create a watertight seal when a headphone jack (not shown) is inserted through the headphone-jack aperture and a sound isolating, acoustic membrane situated over the electronic device's bottommost microphone (not shown).

Referring again to FIGS. 2*e*, 2*f* and 3*e* the front portion 2 connectively seals into the back portion 10 by an interlocking of the registration profile 9 of the sealing mount 8 and the compression profile 13 of the soft shell 12, to complete a waterproof seal. The registration profile 9 and the compression profile 13 preferably form reciprocal profiles.

Figure 3E:
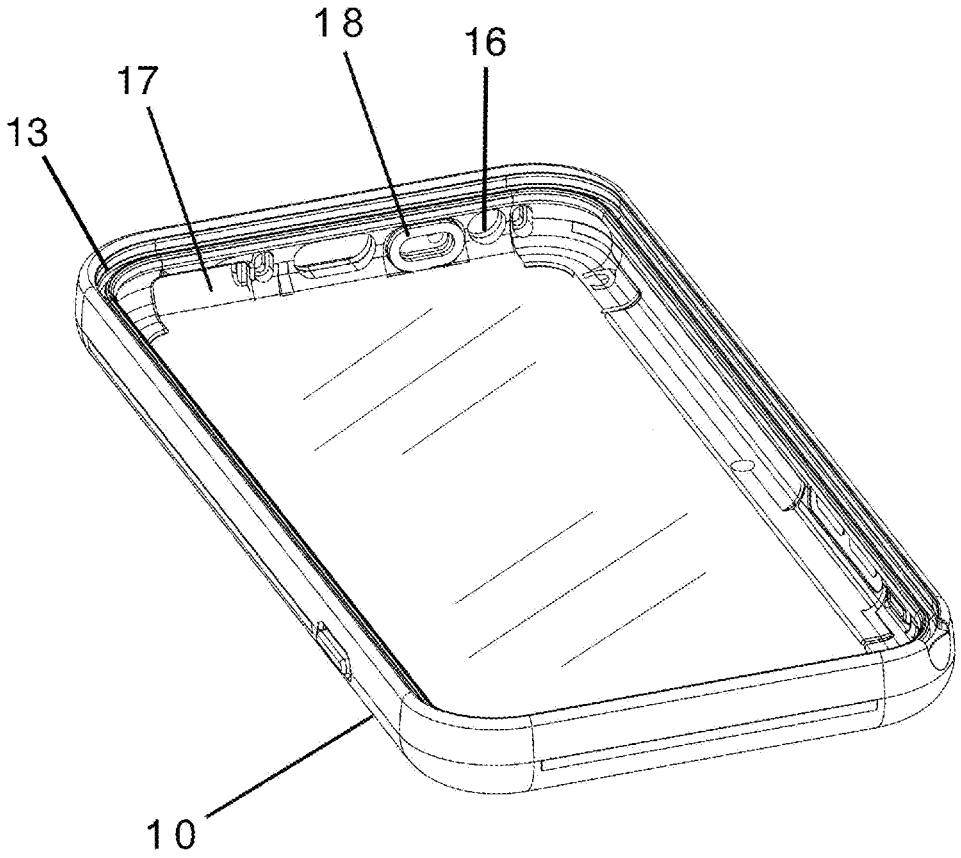
FIG. 3*e* provides a perspective view of the back portion shown in FIG. 1*b*, showing the inner side of the back portion having a compression profile of the compression seal in the soft shell, the sound-isolation chamber for bottom speaker-phone-mode speaker, the sound isolating, acoustic membrane for the mouthpiece microphone and the annular seal for headphone jack aperture.
Figure 3F:
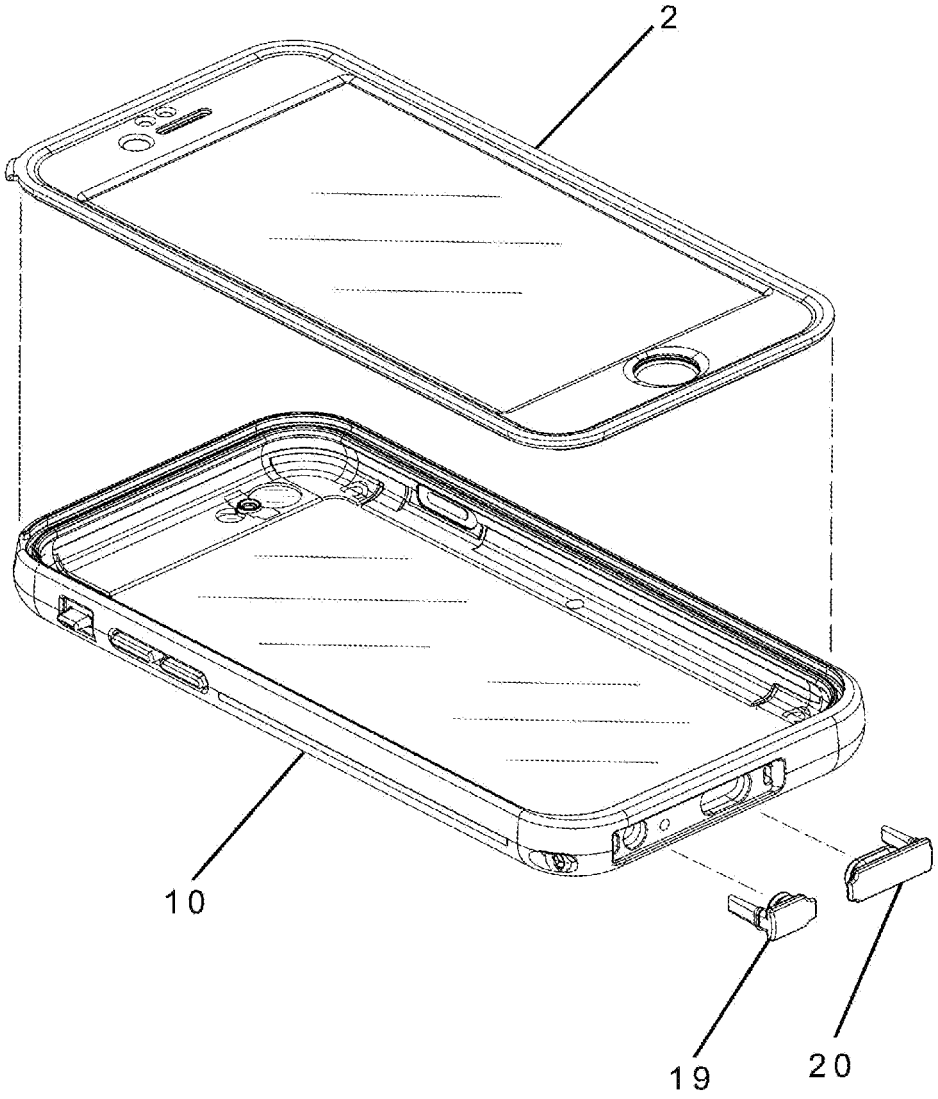
FIG. 3*f* is an exploded perspective view of the front and back portions shown in FIGS. 1*a* and 1*b*, showing the seals for the headphone jack port and charging port of the electronic device.

Referring to FIG. 3*f*, the soft plastic headphone-jack seal 19 and the charger-port seal 20 of the back portion 10 are connected to the frame 11 by means of compression sealing and have several annular convex profiles to create a watertight seal with the shell 12 when inserted into their corresponding apertures.

Figure 3G:
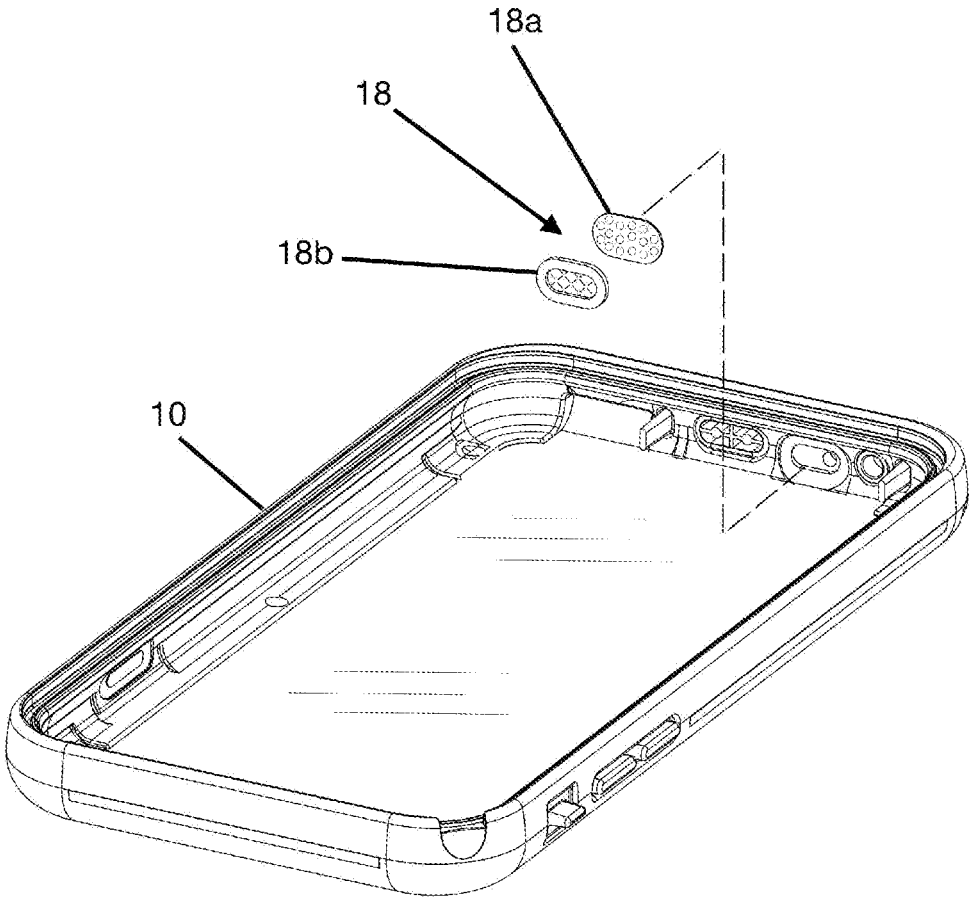
FIG. 3*g* is an exploded perspective view of the sound isolating, acoustic membrane employed in the back portion shown in FIG. 3*e*, showing a flanged silicone membrane and a perforated metal screen.

Referring to FIGS. 3*e* and 3*g*, a sound isolating, acoustic membrane 18 covers the bottommost microphone aperture of the cover 1 corresponding to the electronic device's mouthpiece microphone (not shown). The sound isolating, acoustic membrane 18 includes a perforated metal screen 18*a* and a waterproof seal 18*b* having an annular flange. The screen 18*a* serves to reinforce the seal 18*b*. The membrane 18 isolates incoming sound, directing it into the electronic device's mouthpiece microphone and preventing the incoming sound from reverberating inside the cover 1. The sound isolating, acoustic membrane 18 is preferably dimensioned to fit over or into the mouthpiece-microphone aperture of the bottom region of the back portion 10.

Figure 4A:
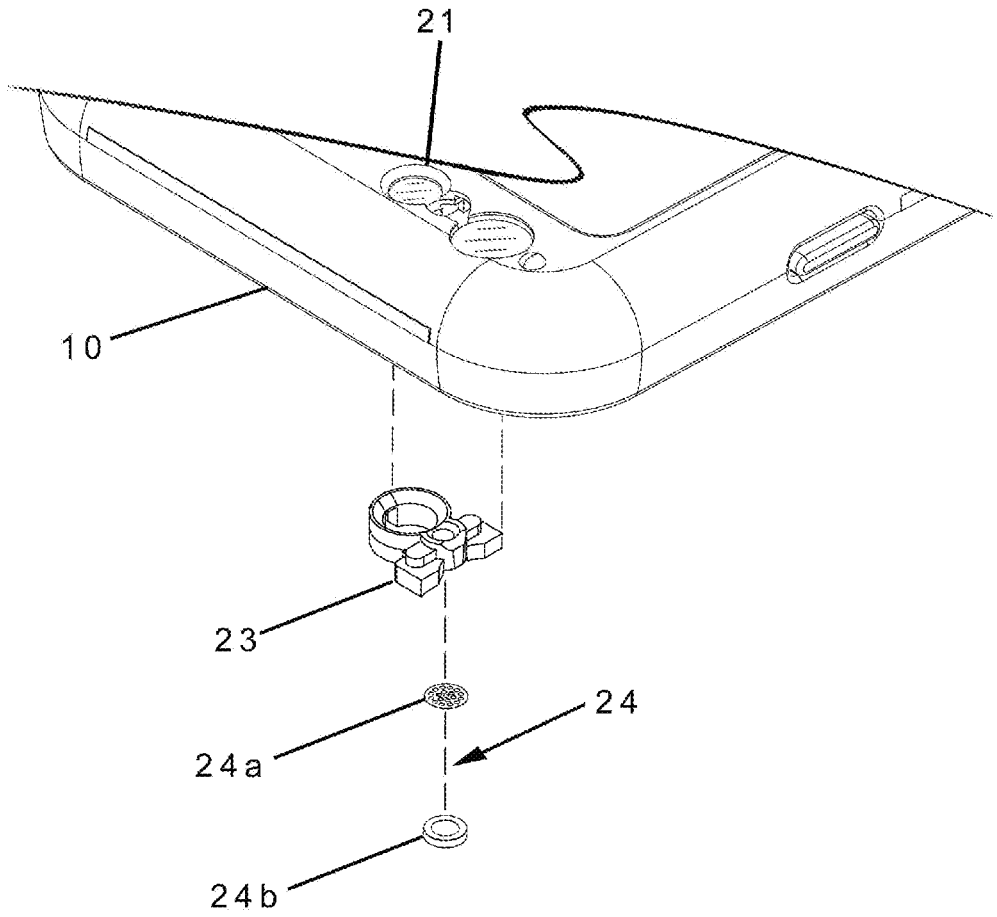
FIG. 4*a* is an exploded partial view of the back portion shown in FIG. 1*b*, showing a flash frame having a partition for the camera and flash apertures and a sound isolating, acoustic membrane on the partition of the frame consisting of a perforated metal screen and a flanged silicone membrane.
Figure 4B:
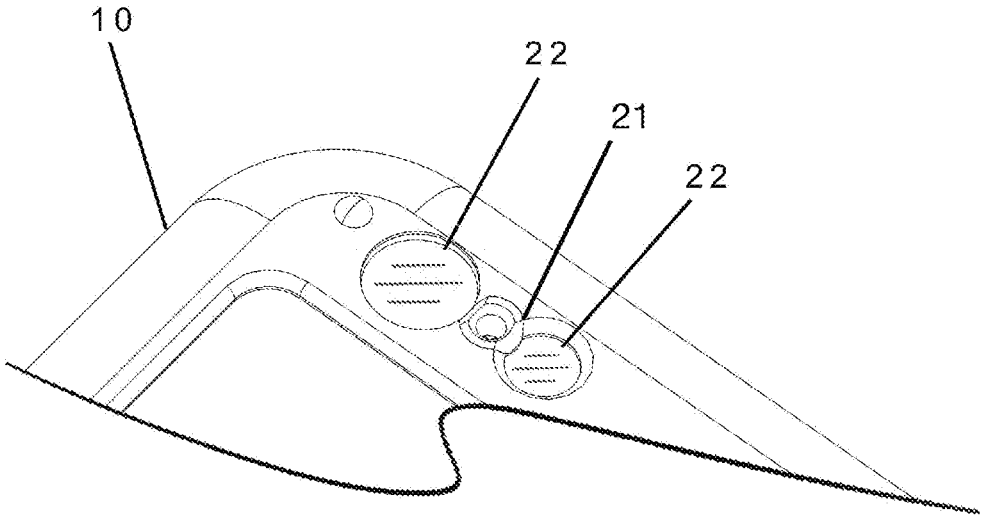
FIG. 4*b* is a partial view of the back portion shown in FIG. 1*b*, showing the outer side of the back portion and showing a flash frame and lenses covering the rear-facing camera and rear-facing flash apertures for a rear-facing camera and flash of the electronic device.
Figure 4C:
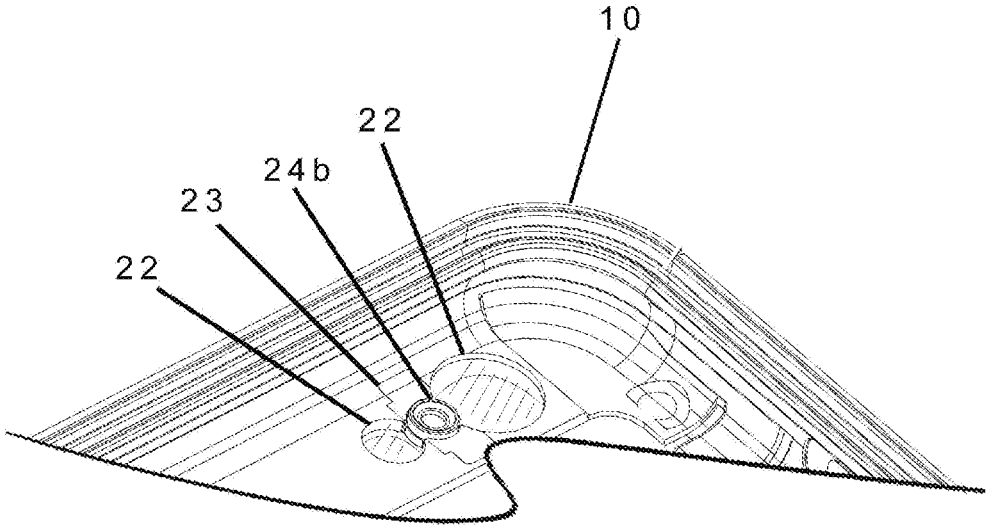
FIG. 4*c* is a partial view of the back portion shown in FIG. 1*b*, showing the inner side of the back portion and showing lenses for the rear-facing camera and flash of the electronic device, the partition in the camera frame and the flanged silicone membrane covering the aperture in the partition for the electronic device's auxiliary microphone.

Referring to FIGS. 4*a* to 4*c*, the cover 1 comprises a fully integrated camera frame 21 for the rear-facing camera (not shown) and flash (not shown) of the electronic device (not shown). The camera frame 21 is thermally and chemically bonded to the hard, translucent frame 11 during the injection molding process. The camera-flash frame 21 can be manufactured by over-molding the camera frame 21 to the translucent frame 11. The camera-flash frame 21 encases the lenses 22, which are dimensioned to protect the rear-facing camera and the flash of the electronic device. The lenses 22 are contiguous with the translucent frame 11. The perimeter of the lens and flash apertures of the camera-flash frame 21 are angled at 45° to augment the passage of light through the camera frame 21. The camera-flash frame 21 incorporates a partition 23 between the camera lens and flash apertures to diffuse reflection and prevent glare from the flash on the rear-facing camera lens. A waterproof, sound isolating, acoustic membrane 24 is adhered over an aperture in the partition 23 of the camera-flash frame 21. The waterproof, sound isolating, acoustic membrane 24 includes a perforated metal screen 24*a* and a waterproof seal 24*b* having an annular flange. The screen 24*a* serves to reinforce the seal 24*b*. The seal 24*b* includes a membrane, which may be a silicone membrane, extending across the annular region of the annular flange. The sound isolating, acoustic membrane 24 is operable to permit the transmission of sound therethrough while maintaining water-tightness of the cover 1. The partition 23 aligns with the auxiliary microphone of the electronic device that is located between the rear-facing camera lens and the flash lens of the electronic device. The sound isolating, acoustic membrane 24 and the partition 23 together isolate incoming sound, directing it into the auxiliary microphone (not shown) and preventing the incoming sound from reverberating inside the cover 1.

Referring to FIGS. 1*a* to 4*c*, each of the hard, translucent plastic frame 11, soft shell 12, protective membrane 3 with plastic border 4, and the camera frame 21 are form-fitted to correspond to the particular electronic device (not shown) for which it is designed, including the configurations of the electronic device's peripheral controls, apertures, sensors, forward-facing and rear-facing cameras and screen. For example, the electronic device typically has a ring/silent toggle switch, volume controls, an earpiece speaker, a microphone, a home button, a speakerphone-mode speaker, a forward-facing camera lens, a rear-facing camera lens, a flash lens, an auxiliary microphone and a power button. In order to allow proper functioning of these electronic-device features, the cover 1 has respective areas and cover 1 features corresponding to these features of the electronic device (not shown).

FIGS. 5*a* to 8*c* show a cover 26 in accordance with a second embodiment of the invention.

Figure 5A:
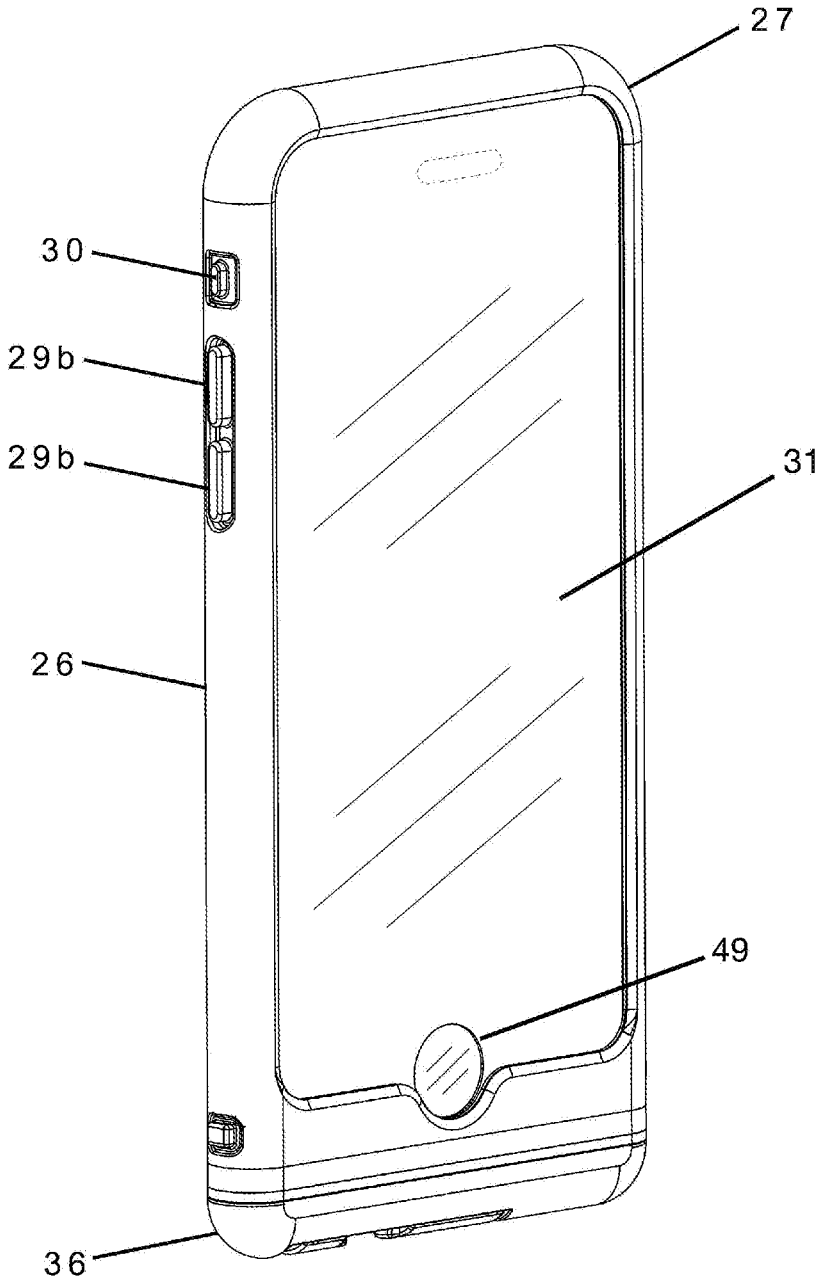
FIG. 5*a* is a front perspective view of a cover according to a second embodiment of the invention, showing a top portion connected to an end-cap to form a waterproof enclosure for the electronic device, the cover having a protective membrane with a waterproof membrane for covering the electronic device's home button and molded enclosures for the silent/ring toggle switch and volume control buttons.
Figure 5B:
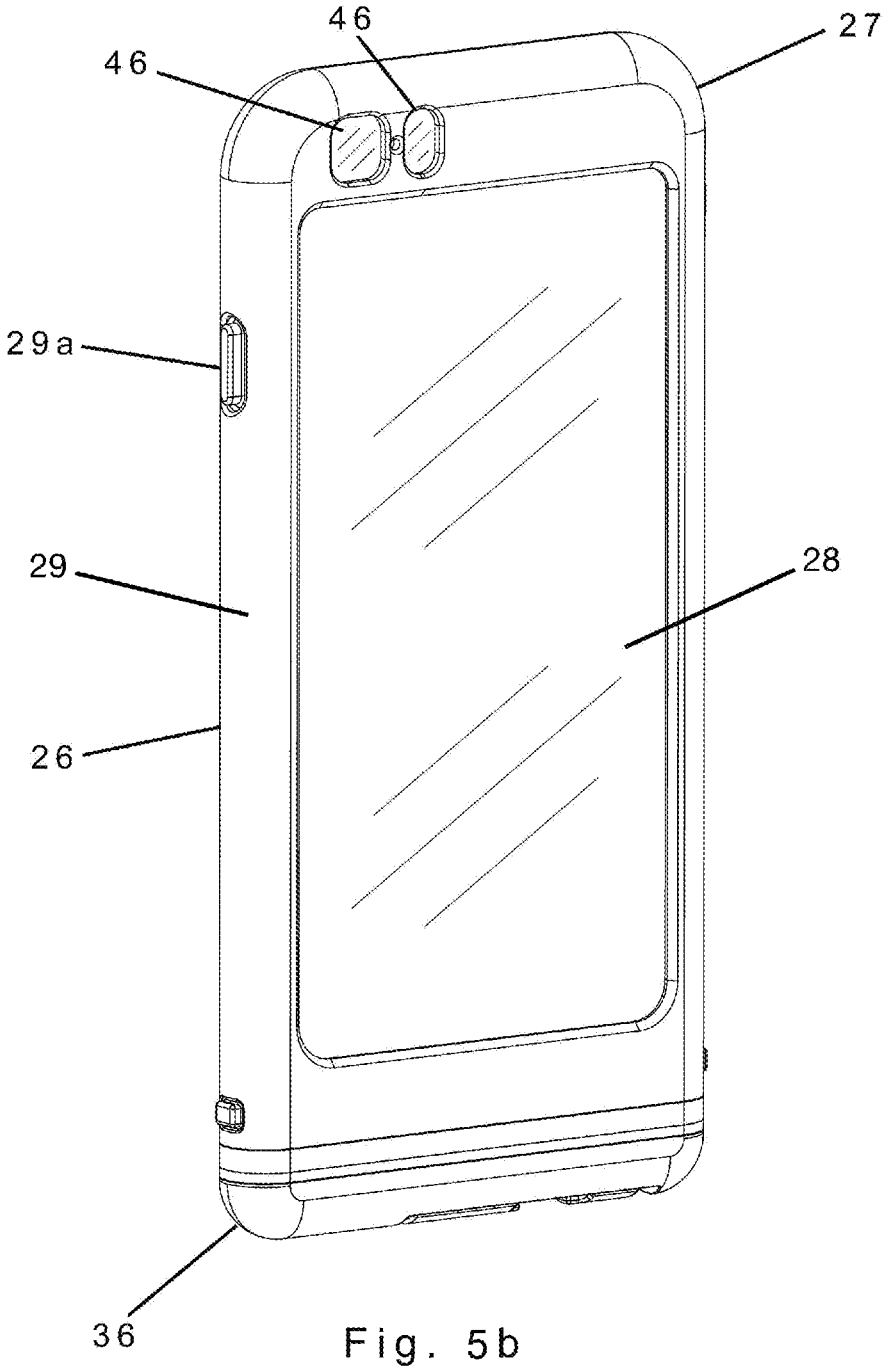
FIG. 5*b* is a rear perspective view of the cover shown in FIG. 5*a*, showing the end-cap connected to the top portion to form the waterproof enclosure, the cover having a hard plastic, translucent frame that is over-molded by a soft, elastomeric shell, a molded enclosure for the power toggle button and a camera-flash frame with lenses for covering the electronic device's camera and flash.

Referring to FIGS. 5*a* and 5*b*, the cover 26 has a bottom portion or "end-cap" 36 and a top portion 27. The top portion 27 has sides and an open bottom through which an electronic device can be inserted into the top portion 27 prior to connectively sealing the top portion 27 and the end-cap 36 together to create a waterproof enclosure by the cover 26.

The top portion 27 comprises a protective membrane 31 attached to a hard plastic translucent frame 28 that is over-molded with a soft elastomeric shell 29. The shell 29 typically has a durometer in the range of 60 Shore A to 90 Shore A, such that the shell 29 is soft relative to the translucent frame 28. The protective membrane 31 is positioned so as to correspond to the position of the screen (not shown) of the electronic device to be placed in the cover 26. During manufacturing, the frame 28 and the soft shell 29 are thermally and chemically fused together. The translucent frame 28 contains apertures and cut-outs that provide access to the protrusions and contours of the shell 29. The protrusions and contours of the shell 29 correspond to the positions of the electronic device's apertures and peripheral controls (not shown). In the first embodiment, the shell 29 includes a power toggle switch enclosure 29*a*, volume switches enclosures 29*b*, and ring/silent toggle switch cap 30, lenses 46 covering the rear-facing camera and rear-facing flash apertures and a waterproof membrane 49 for covering the electronic device's home button (not shown).

Figure 6A:
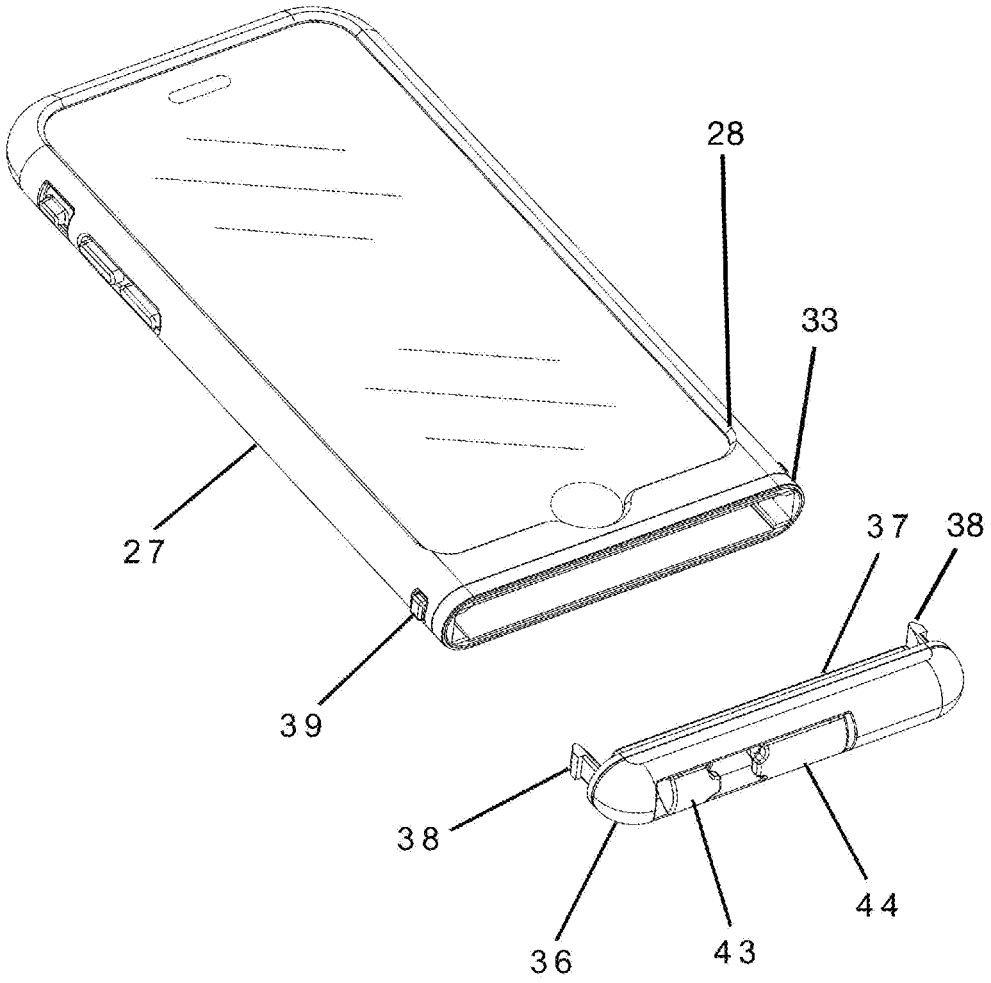
FIG. 6*a* is a perspective view of the top portion and end-cap shown in FIG. 5*a*, showing the end-cap disconnected from the top portion, in which the top portion has a sealing mount with a female profile for a compression seal molded into the hard plastic frame and a locking mechanism compression release molded into the soft shell, the end-cap has a male profile for a compression seal and registration latches for the locking mechanism, and respective seals for the headphone jack port and charging port of the electronic device are in closed positions.

Referring to FIG. 6*a*, a sealing mount 33 is contiguous with and forms part of the frame 28. The inner perimeter of the plastic frame 28 that borders the protective membrane 31 is angled at 45° to maximize the contact area on the electronic device's touch-screen display (not shown). The hard plastic end-cap 36 connectively seals into the sealing mount 33 with a combination of reciprocal registration and compression profiles to complete a waterproof seal. The registration profile 37 encompasses the perimeter of the end-cap 36 and may be manufactured entirely in silicone and be fully integrated to the hard plastic outer member 36*a* (FIG. 7*b* described herein below) of the end-cap 36 during the molding process. The end-cap 36 further features a locking mechanism comprised of two male, registration latches 38. The sealing mount 33 in the second embodiment is over-molded with reciprocal, female receptacles 35 that correspond to the position of the registration latches 38 on the end-cap 36. The soft shell 29 features molded compression releases 39 that correspond to the position of the locking mechanism receptacles 35 in the sealing mount 33. When the end-cap 36 is connected to the top portion 27 at its sealing mount 33 by insertion into the open end of the top portion 27 of the cover 26, the registration latches 38 and receptacles 35 lock inter-connectedly. The registration latches 38 and receptacles 35 can be releasably unlocked by compression through the molded compression releases 39 in the soft shell 29. A seal 43 on the outer side of the end-cap 36 closes the headphone-jack aperture with a waterproof seal when the headphone jack (not shown) is not in use. The seal 43 may be similar or analogous to the seal 19 of the first embodiment. Also, the seal 44 for the electronic device's charging port (not shown) may be similar or analogous to the seal 20 of the first embodiment. The seals 43 and 44 are shown in closed positions in FIG. 6*a*.

Figure 6B:
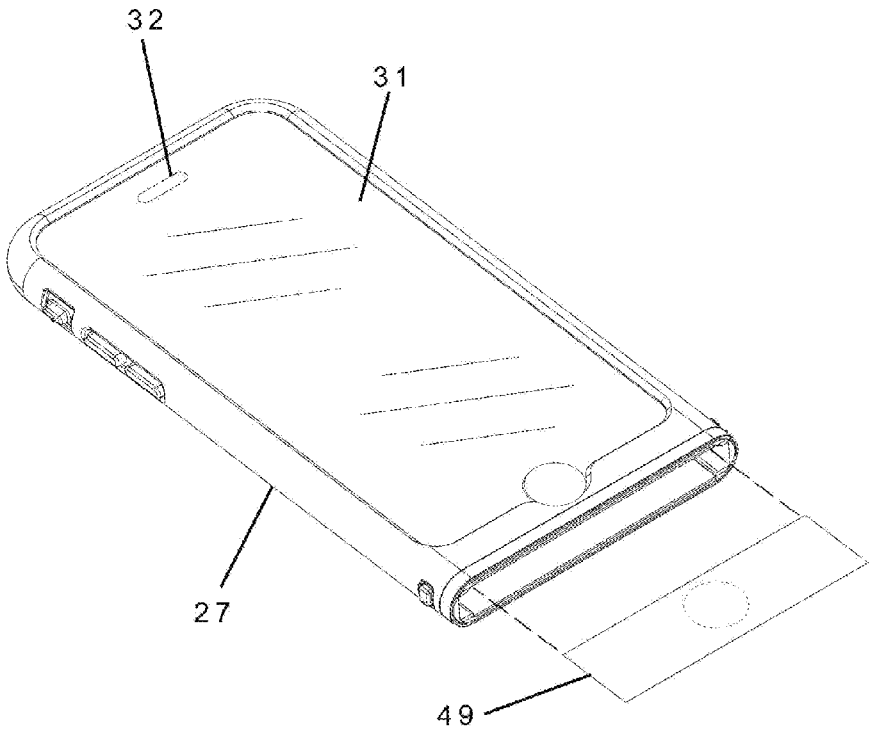
FIG. 6*b* is a perspective exploded view of the top portion shown in FIG. 5*a*, showing a thin, ellipsoidal convexity molded into the protective membrane for being situated over the electronic device's earpiece speaker, enclosures for the electronic device's ring/silent toggle and volume switches molded into the soft shell and a home-button membrane.

Referring to FIG. 6*b*, the protective membrane 31 features a thin, ellipsoidal convexity 32 (i.e. convex protrusion) dimensioned for being situated over the electronic device's earpiece speaker (not shown) to form an acoustic membrane for the earpiece speaker. The protective membrane 31 features an aperture dimensioned for being situated over the electronic device's home button (not shown). The home button on the electronic device is designed so that it scans, reads and recognizes fingerprints but it also relies on bio-electromagnets (electromagnetic fields produced by living cells, tissues or organisms). The cover 26 provides an ultra-thin, waterproof, tear-resistant home-button membrane 49 conducive to "fingerprint recognition" or digital authentication technology. In the second embodiment, the home-button membrane 49 allows for fingerprint recognition by the electronic device via the electronic device's home button (not shown) through the home-button membrane 49. The home-button membrane 49 is adhesively attached to the interior side of the plastic border region of the plastic frame 28 and has been embossed to form-fit to the curvature or concavity of the electronic device's home button. The home-button membrane 49 may be similar or analogous to the home-button membrane 25 of the first embodiment.

Figure 6C:
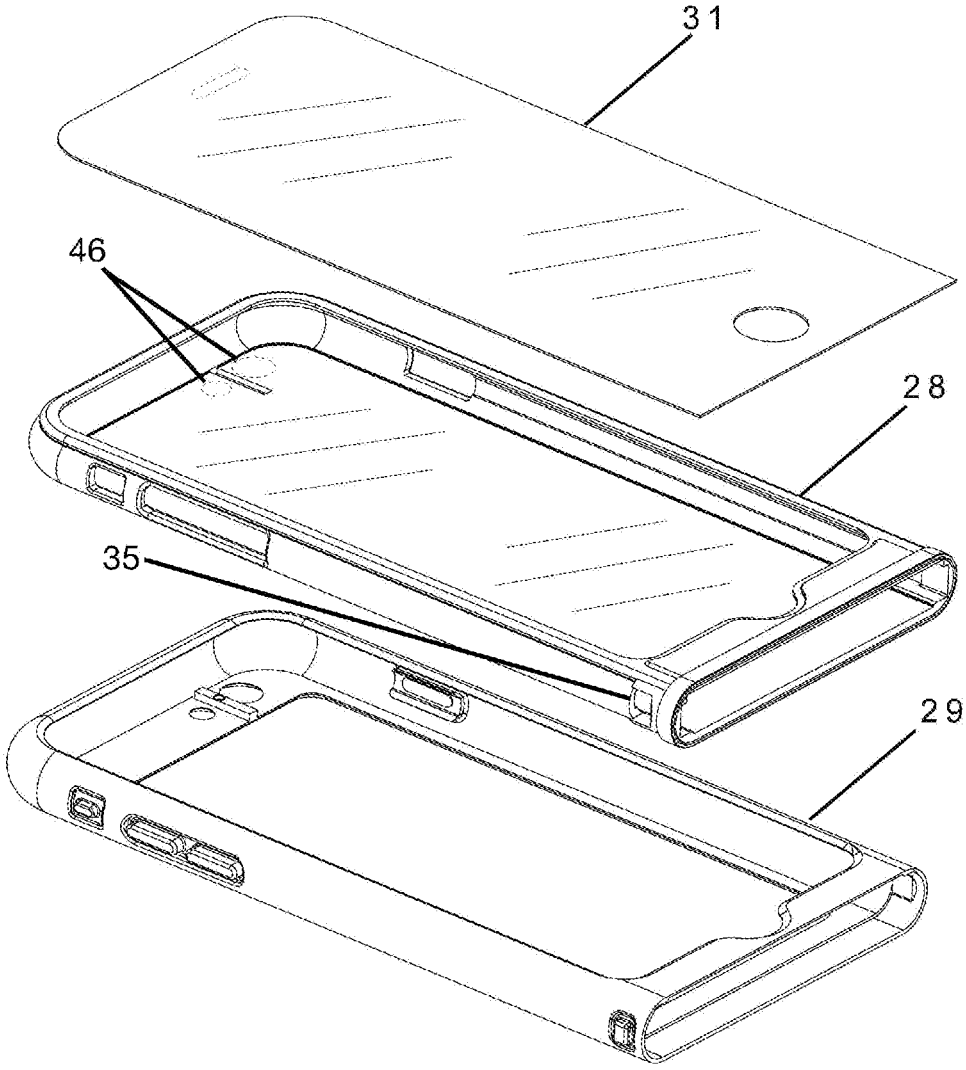
FIG. 6*c* is an exploded view of the top portion shown in FIG. 5*a*, showing a protective membrane, a hard plastic frame forming a congruous sealing mount with receptacles for a compression locking mechanism and integrated lenses for camera and flash apertures, and a soft shell.

FIG. 6*c* depicts the protective membrane 31, and the hard plastic, translucent frame 28 that is over-molded with the soft, elastomeric shell 29. The translucent frame 28 integrates lenses 46, for apertures of the shell 29 that are associated with the electronic device's rear facing camera (not shown) and flash (not shown). The frame 28 includes receptacles 35 for its compression locking mechanism.

Figure 6D:
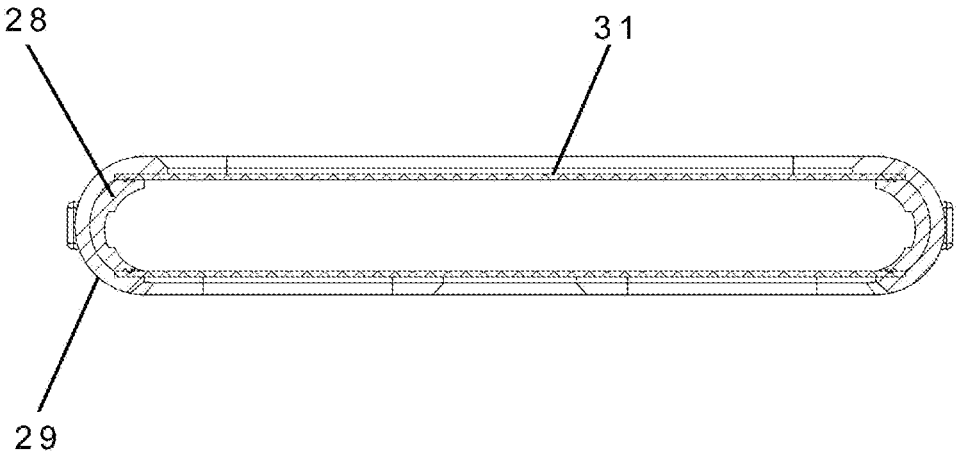
FIG. 6*d* is a cross-sectional view of the top portion shown in FIG. 6*a*, showing the protective membrane and the hard, translucent plastic frame over-molded with the soft plastic shell.

FIG. 6*d* depicts the protective membrane 31, and the hard plastic, translucent frame 28 that is over-molded with the soft, elastomeric shell 29.

Figure 6E:
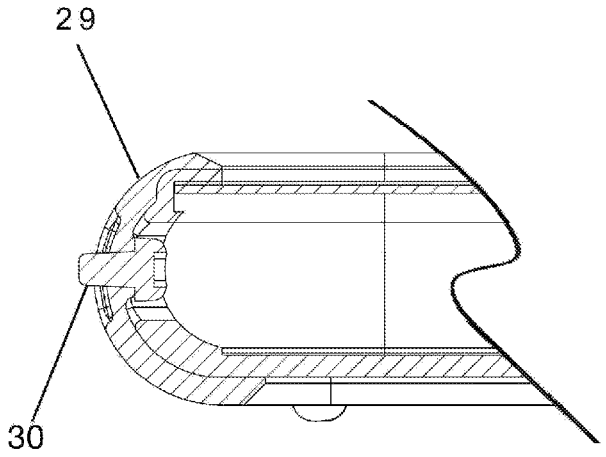
FIG. 6*e* is a cross-sectional view of a cut-out of the top portion shown in FIG. 6*a*, showing a hard plastic cap protruding through the shell to form an enclosure for the electronic device's ring/silent toggle switch.

Referring to FIG. 6*e*, the shell 29 incorporates a hard plastic cap 30 that is contoured to fit over the electronic device's ring/silent toggle switch (not shown) allowing the switch to be actuated with mechanical advantage. The cap 30 is partially over-molded by the shell 29 so that the cap 30 partially protrudes through the shell 29. The toggle switch cap 30 is thermally and chemically incorporated to the soft shell 29 during the injection molding process. The cap 30 may be similar or analogous to the cap 15 of the first embodiment.

Figure 7A:
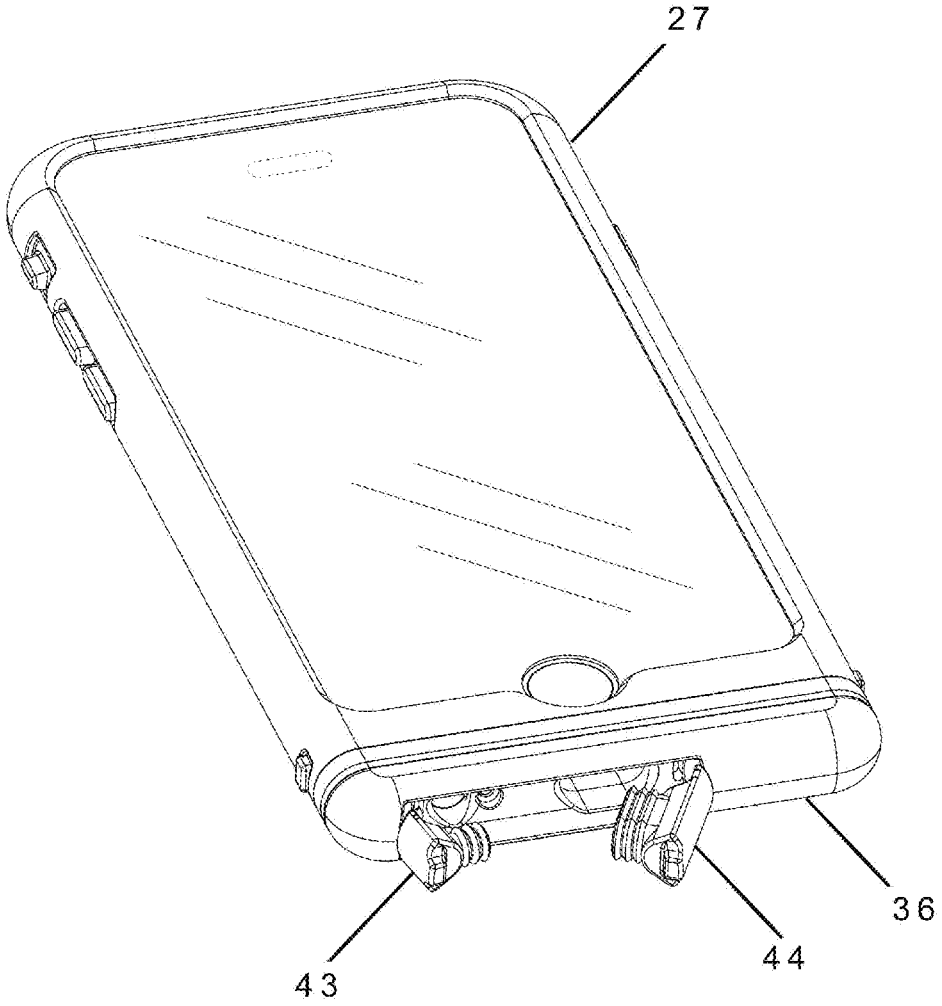
FIG. 7*a* is a front perspective view of the cover shown in FIG. 5*a*, showing the respective seals for the headphone, jack port and charging port of the electronic device that are in the end-cap in their opened positions.

Referring to FIG. 7*a*, the soft plastic seals 43 and 44 for the headphone-jack and charger-port apertures of the hard plastic outer member 36*a* are connected to the end-cap 36 by means of compression seals and have several annular convex profiles to create a watertight seal when inserted into end-cap 36 apertures.

Figure 7B:
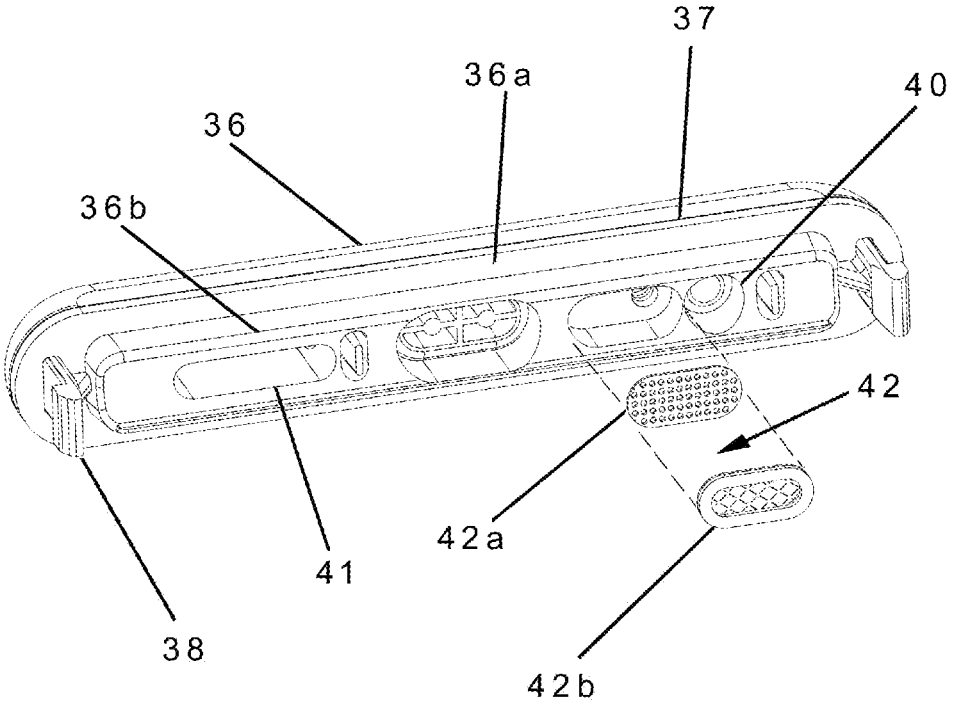
FIG. 7*b* is a perspective and exploded view of the end-cap shown in FIG. 6*a*, showing a hard plastic outer member having male profile registration seals and latches, which over-molds and encases a soft, elastomeric inner member having a sound-isolation chamber for the bottom speaker, an annular seal for a headphone jack aperture and a sound isolating, acoustic membrane consisting of a flanged silicone membrane and a perforated metal screen.

Referring to FIG. 7*b*, the end-cap 36 comprises a soft, elastomeric inner member 36*b* over-molded with or over-molded into the hard plastic outer member 36*a*. The soft inner member 36*b* is disposed on an interior side of the hard plastic outer member 36*a*. The protrusions and contours in the inner side of the soft inner member 36*b* correspond to the positions of various features of the electronic device (not shown). The end-cap 36 incorporates a molded annular seal 40 for the electronic device's headphone-jack aperture to create a watertight seal when a headphone jack (not shown) is inserted into the headphone-jack aperture of the end-cap 36. A sound-isolation chamber 41 for the speakerphone-mode speaker (not shown) is fully incorporated into the end-cap 36. The sound-isolation chamber 41 isolates sound emitted from the speakerphone-mode speaker and transmits it from the speakerphone-mode speaker into the acoustic chamber space of the cover 26. The sound-isolation chamber 41 may be similar or analogous to the chamber 17 of the first embodiment. When the electronic device is being encased by the cover 26, the acoustic chamber in the second embodiment extends between the rear side of the electronic device and an inward face of the rear side of the top portion 27. A sound isolating, acoustic membrane 42 covers or fills the mouthpiece-microphone aperture of the hard plastic outer member 36*a* and may be fully integrated into the end-cap 36 during the molding process. The membrane 42 includes a waterproof seal 42*b* with an annular flange and a perforated metal screen 42*a*. The screen 42*a* serves to reinforce the flanged seal 42*b*. The membrane 42 isolates incoming sound, directing it into the electronic device's microphone (not shown) and preventing the incoming sound from reverberating inside the cover 26. The membrane 42 may be similar or analogous to the membrane 18 of the first embodiment.

Figure 8A:
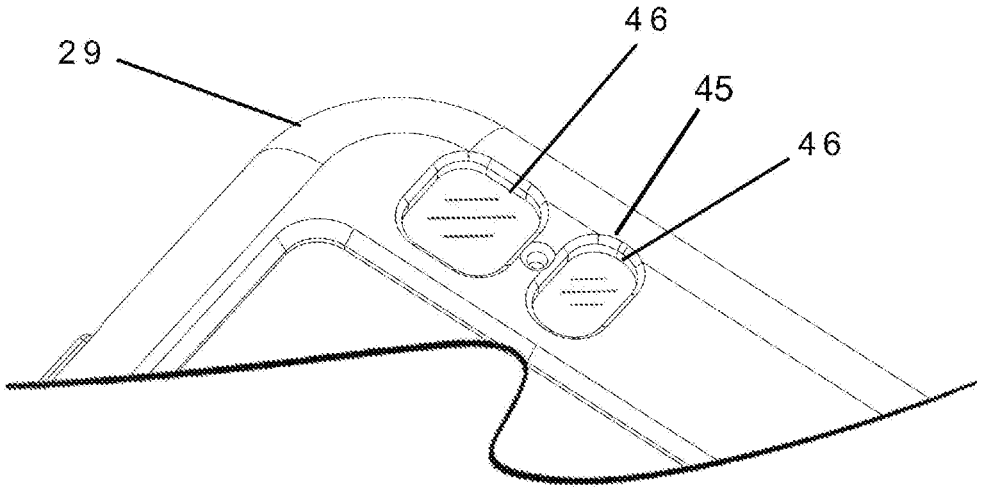
FIG. 8*a* is a partial view of the top portion shown in FIG. 5*b*, showing an outer side of the top portion and showing a camera frame for the rear-facing camera and flash of the electronic device.
Figure 8B:
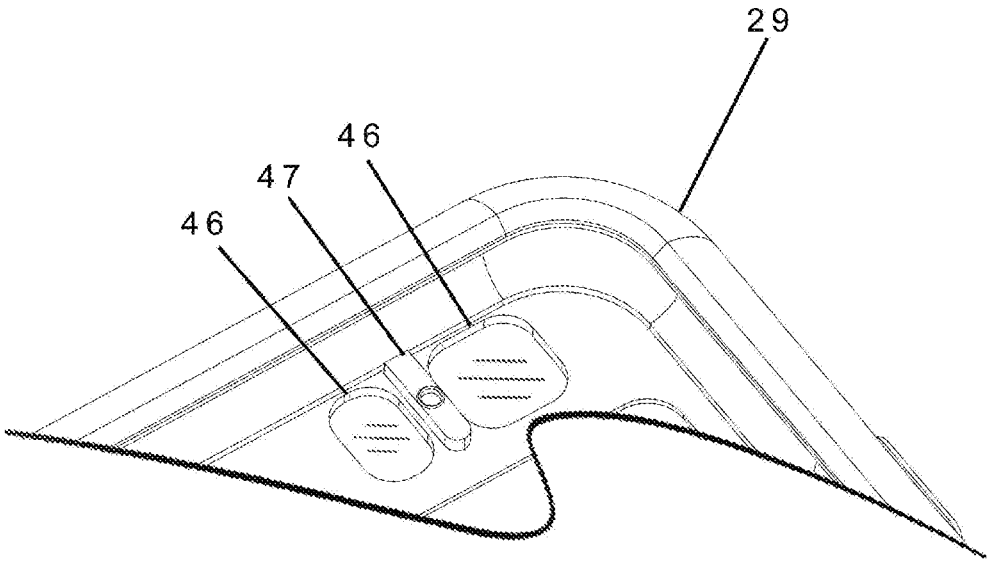
FIG. 8*b* is a partial view of the top portion shown in FIG. 5*b*, showing an inner side of the top portion and showing a partition of the camera frame.
Figure 8C:
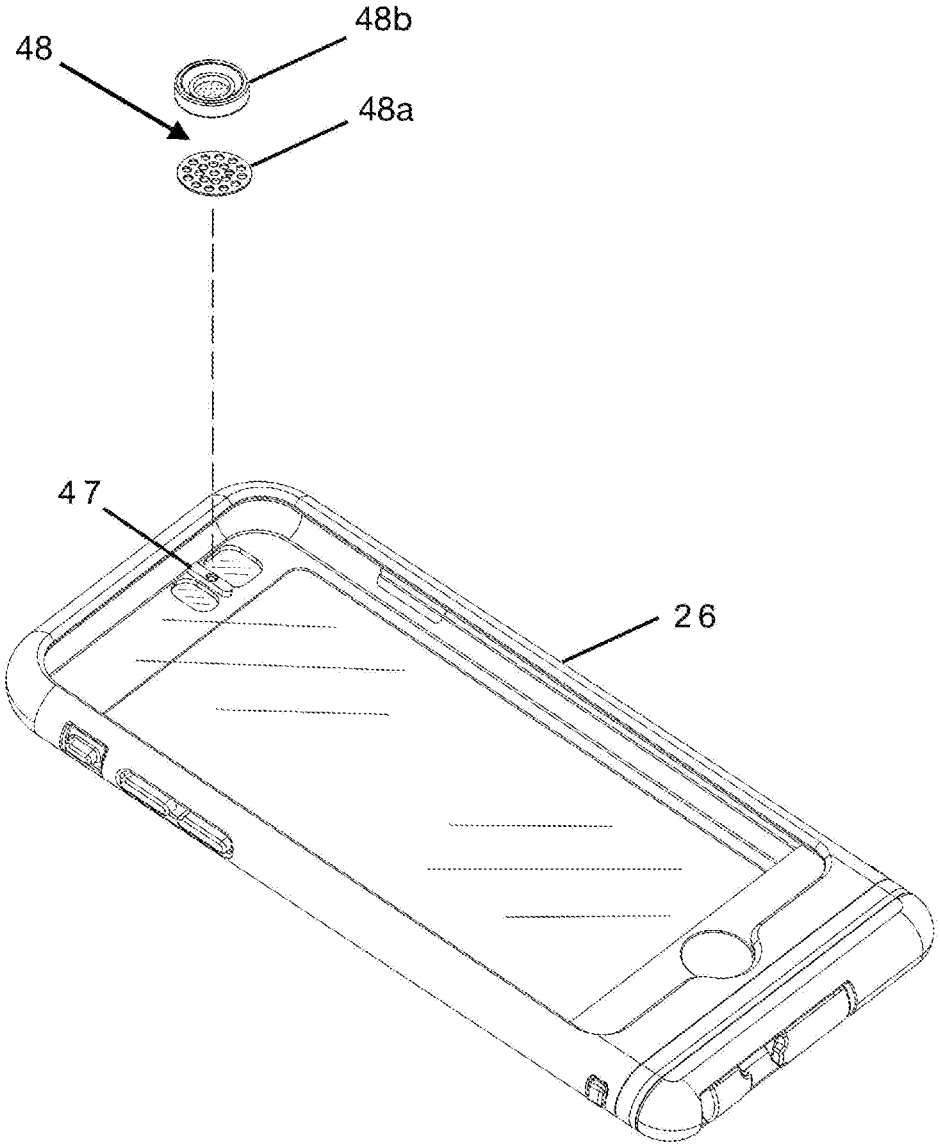
FIG. 8*c* provides a perspective view of the top portion shown in FIG. 5*b*, showing an exploded view of a sound isolating, acoustic membrane for the auxiliary microphone of the electronic device, the sound isolating, acoustic membrane being located in the center of the partition in the camera-flash frame and consisting of a flanged silicone membrane and a perforated metal screen.

Referring to FIGS. 8*a* to 8*c*, the cover 26 comprises a fully integrated camera-flash frame 45 for the rear-facing camera (not shown) and the flash (not shown) of the electronic device. The camera-flash frame 45 is thermally and chemically bonded to the hard, translucent frame 28 in the injection molding process. The camera-flash frame 45 includes a camera lens aperture and a flash lens aperture, which are covered by lenses 46 that are congruous with the translucent frame 28. The perimeter of the lens and flash apertures are angled at 45° to augment the passage of light through the lens and flash apertures. The camera-flash frame 45 incorporates a partition 47 between the camera lens aperture and the flash lens aperture to diffuse reflection and prevent glare from the flash (not shown) on the camera lens.

The partition 47 includes an aperture for the electronic device's auxiliary microphone (not shown) located between the camera and flash. The camera-flash frame 45 may be similar or analogous to the camera-flash frame 21 of the first embodiment.

Referring to FIG. 8*c*, a sound isolating, acoustic membrane 48 is adhered over or into the partition 47 aperture. The sound isolating, acoustic membrane 48 includes a perforated metal screen 48*a* and a waterproof seal 48*b* having an annular flange. The screen 48*a* serves to reinforce the seal 48*b*. The acoustic membrane 48 isolates incoming sound, directing it into the electronic device's auxiliary microphone (not shown) located between the electronic device's camera and flash lenses (not shown), and preventing the incoming sound from reverberating inside the cover 26. The membrane 48 may be similar or analogous to the membrane 24 of the first embodiment.

Referring to FIGS. 5*a* to 8*c*, each of the hard, translucent plastic frame 28, soft shell 29, protective membrane 31, sealing mount 33, and the end-cap 36 are form-fitted to the electronic device (not shown) for which the cover 26 is designed, including the configurations of the electronic device's peripheral controls, apertures, sensors camera and screen. For example, the electronic device has a ring/silent toggle switch, volume controls, an earpiece speaker, a mouthpiece microphone, a home button, a speakerphone-mode speaker, a camera lens, a flash, an auxiliary microphone and a power button. In order to allow proper functioning of these electronic device features, the cover 26 has respective areas and cover 26 features correspond to these features of the electronic device (not shown).

It will be appreciated by those skilled in the art that the preferred and alternative embodiments have been described in some detail but that certain modifications may be practiced without departing from the principles of the invention.

Materials

The soft shells 12, 29 and/or the covers 1 and/or 26 are preferably manufactured from thermoplastic polyurethane (TPU). It is also contemplated that thermoplastic elastomers (TPE) could be used. The soft shells 12 and/or 29 may also have a soft-touch coating based on polyurethane (PU) materials to create a low gloss, silky-feel surface that is resistant to abrasion and scratching.

The translucent frame 11 and/or 28 are typically made from a hard, translucent polycarbonate (PC). Alternatively, an acrylic or polymethyl methacrylate (PMMA) may be used. The lenses 22 and/or 46, covering the rear facing camera and flash apertures, are preferably created by applying a high gloss polish to the translucent frame 11 and/or 28 molds.

The camera-flash frame 21 and/or 45 and the end-cap outer member 36*a* are typically made from a hard polycarbonate (PC). Alternatively, acrylic, nylon or a PC and nylon blend may be used.

The sealing mounts 8 and/or 33 may be manufactured from PC and over-molded with silicone, or alternatively may be manufactured entirely of silicone.

The protective membrane 3 is preferably made of tempered glass that is treated with protective ultra-violet (UV) and oleophobic coatings with a silicone substrate applied to one surface that allows the protective membrane 3 to chemically adhere to the electronic device's screen (not shown). The glass membrane includes a transparent film 6 applied over the silicon substrate that may prevent the protective membrane 3 from adhering to the electronic device's screen if the transparent film is not removed. The profiles of the protective membranes 3 and/or 31 are cut from glass on a computer numerical control (CNC) machine. The glass profiles are then tempered. The protective membrane 3 and/or 31 may or may not include an edging or border, such as the border 4 or similar, around the outer perimeter of the protective membrane 3 and/or 31. A hard PC or silicone frame, such as the sealing mount 8 and/or 33 is then attached to the perimeter of the protective membrane 3 and/or 31.

It is also contemplated that other materials may be used for the protective membrane 3 and/or 31. For example, a polycarbonate (PC) film, acrylic or polyethylene terephthalate (PET or PETE) film or polyethylene terephthalate glycol (PETG) film or a polyester sheet such as Mylar® could be used to form the protective membranes 3 and/or 31. An example of a suitable PC film is that marketed under the trademark LEXAN®. Said films may also be treated with protective ultra-violet (UV) and oleophobic coatings, and such films may or may not have a silicone substrate and transparent film 6 applied to the inner surface to optionally prevent the protective membrane 3 and/or 31 from chemically adhering to the electronic device's screen (not shown).

The acoustic membrane 7, which is situated over the electronic device's earpiece speaker (not shown) when the cover 1 is enclosing the electronic device, is in some embodiments a three-layer composition of hydrophobic material (polymethylene) 7*b*, perforated aluminum screen 7*a*, and a PORON® gasket 7*c*. Alternatively, the hydrophobic material 7*b* may be replaced with a silicone membrane; the gasket 7*c* may be manufactured from rubber, silicone or TPU; and the aluminum screen 7*a* could be comprised of an alternative metal, metal alloy or a hard PC. Alternative embodiments of the acoustic membrane 7 involve a two or three-part composition, whereby either the gasket 7*c* or the metal screen 7*a* may not be included.

The borders (e.g. border 4 shown in FIG. 2*a*) on the protective membranes 3 are typically made from PC. Alternatively, the borders 4 may be made from thin metal plating or be silkscreened onto the protective membranes 3.

The transparent film (e.g. membrane 5 shown in FIG. 2*b*) attached to the interior of the borders is preferably made from PC.

The sound isolating, acoustic membrane 18 and/or 42 for the mouthpiece-microphone aperture is typically made from silicone and perforated aluminum plating. It is contemplated that the acoustic membranes 18 and/or 42 could be comprised of a hydrophobic material and an alternative metal, metal alloy or a hard PC.

Each of the sound isolating, acoustic membranes 24 and/or 48 for the auxiliary microphone aperture located in the partition 23 and/or 47 of the camera-flash frame 21 and/or 45 typically include a flanged waterproof seal made from silicone and a screen made from perforated aluminum plating. It is contemplated that the acoustic membranes 18 and/or 42 could alternatively be comprised of a hydrophobic material and an alternative metal, metal alloy or a hard PC.

The home-button membrane 25 and/or 49 is made from a Teflon® coated polymethylene and is adhesively attached to the protective membrane 3 and/or 31, respectively. The membrane 25 and/or 49 may be colored and opaque or may be translucent. An example of a suitable adhesive is that manufactured by 3M®.

The soft, elastomeric inner member 36*b* in the end-cap 36 is typically manufactured from silicone, but TPU, rubber or PORON® may alternatively be used.

The seals for the headphone jack 19 and/or 43 and the charging port 20 and/or 44 are typically manufactured from TPU, but rubber or silicone may alternatively be used.

It will be appreciated by those skilled in the art that various components may be made of different materials, and/or different durometers of materials.

What is claimed is:

1. A cover for forming a watertight enclosure enclosing an electronic device having a display, the cover comprising:

(a) a first member comprising:

(i) a protective membrane operable to transmit touch-screen-type user input to the display; and (ii) a sealing mount attached to said protective member, said sealing mount defining a registration profile extending along the entire perimeter of said protective membrane, said sealing mount defining a stanchion projecting parallel and spaced-apart from said registration profile; and (b) a second member comprising:

(iii) a second-member frame made of a rigid plastic material; and (iv) a shell over-molded to said second-member frame, said shell being made of a soft and elastomeric material, said shell defining a compression profile extending along the entire perimeter of said shell, said shell at said compression profile being dimensioned for interlocking with said sealing mount at said registration profile so as to removably form a watertight seal between said first and second members.

2. The cover of claim 1 wherein said protective membrane is made of a material selected from the group consisting of: glass, and plastic.

3. The cover of claim 2 wherein said registration profile comprises a core made of rigid plastic and an overlay portion made of silicone, said overlay portion being overmolded to said core, said core and said stanchion being integral to each other.

4. The cover of claim 2 wherein said sealing mount is made solely of silicone.

5. The cover of claim 4 wherein said sealing mount is thermally and chemically bonded to said protective membrane.

6. The cover of claim 1 wherein said first member comprises a first acoustic membrane attached to said protective membrane at a border region of said protective membrane, said first acoustic membrane comprising:

(i) an annular foam gasket, and (ii) a membrane member disposed adjacent to said annular foam gasket, and wherein said first acoustic membrane is operable to isolate sound and is dimensioned for alignment with an earpiece speaker of the electronic device, said gasket being operable to guide sound therethrough, said membrane member being selected from the group consisting of a waterproof member and a hydrophobic member.

7. The cover of claim 6 wherein said second member comprises a second acoustic membrane attached to said shell, said second acoustic membrane being operable to isolate sound, said second acoustic membrane comprising a second waterproof membrane member and at least one annular wall projecting from said second waterproof membrane member, said at least one annular wall being operable to guide sound therethrough, and wherein said second acoustic membrane is dimensioned for alignment with a mouthpiece microphone of the electronic device.

8. The cover of claim 7 wherein at least one of said first member and said second member comprises a third acoustic membrane being operable to isolate sound, said third acoustic membrane comprising a third waterproof membrane member and at least one annular wall projecting from said third waterproof membrane member, said at least one annular wall being operable to guide sound therethrough, and wherein said third acoustic membrane is dimensioned for alignment with an auxiliary microphone of the electronic device.

9. The cover of claim 8 wherein said second member defines a sound-isolation chamber dimensioned for placement into fluid communication with a speakerphone-mode speaker of the electronic device, said sound-isolation chamber being dimensioned to isolate sound emitted from said speakerphone-mode speaker and transmit said sound from the speakerphone-mode speaker into an acoustic chamber defined by the cover, said acoustic chamber extending between a rear side of the electronic device and at least one of said first member and said second member when the watertight enclosure is formed.

10. The cover of claim 1 wherein said second-member frame is translucent.

11. The cover of claim 10 wherein said second-member frame comprises a camera-flash frame, said camera-flash frame comprising a partition for acoustically isolating an auxiliary-microphone portion of said camera-flash frame from an acoustic chamber defined by the cover, said partition being over-molded to said second-member frame.

12. The cover of claim 11 wherein said second-member frame contiguously defines a first lens dimensioned for alignment with a rear-facing camera of the electronic device and contiguously defines a second lens dimensioned for alignment with a rear-facing flash of the electronic device, said camera-flash frame encasing said first and second lenses, said first and second lenses being operable to protect the rear-facing camera and the rear-facing flash.

13. The cover of claim 12 wherein said partition of the camera-flash frame is thermally and chemically bonded to said second-member frame.

14. The cover of claim 1 wherein said second member further comprises a rigid plastic cap attached to said shell such that an exterior portion of said rigid plastic cap protrudes outwardly from said shell and an interior portion of said rigid plastic cap engages a toggle switch of the electronic device when the watertight enclosure is formed.

15. The cover of claim 14 wherein said rigid plastic cap is thermally and chemically bonded to said shell.

* * * * *